US009227096B2

(12) United States Patent
Gross et al.

(10) Patent No.: US 9,227,096 B2
(45) Date of Patent: Jan. 5, 2016

(54) FIRE SUPPRESSION APPARATUS AND METHOD FOR USING THE SAME IN AN ENCLOSED COMPARTMENT

(75) Inventors: Marc V. Gross, Shorewood, MN (US); Lawrence T. Weinman, Austin, TX (US)

(73) Assignee: Fireaway Inc., Minnetonka, MN (US)

( * ) Notice: Subject to any disclaimer, the term of this patent is extended or adjusted under 35 U.S.C. 154(b) by 0 days.

(21) Appl. No.: 14/124,051

(22) PCT Filed: Jun. 6, 2012

(86) PCT No.: PCT/US2012/041165

§ 371 (c)(1), (2), (4) Date: Jun. 26, 2014

(87) PCT Pub. No.: WO2012/170581

PCT Pub. Date: Dec. 13, 2012

(65) Prior Publication Data

US 2014/0299336 A1 Oct. 9, 2014

Related U.S. Application Data

(60) Provisional application No. 61/493,856, filed on Jun. 6, 2011.

(51) Int. Cl.
*A62C 13/76* (2006.01)
*A62C 13/22* (2006.01)
(Continued)

(52) U.S. Cl.
CPC ..... *A62C 13/76* (2013.01); *A62C 5/006* (2013.01); *A62C 13/22* (2013.01); *A62C 35/023* (2013.01); *A62C 3/07* (2013.01)

(58) Field of Classification Search
CPC ..... A62C 5/006; A62C 13/22; A62C 13/76; A62C 31/05; A62C 35/023
USPC ..... 169/12, 84; 280/736, 737, 740, 741; 102/530, 531
See application file for complete search history.

(56) References Cited

U.S. PATENT DOCUMENTS 3,972,545 A * 8/1976 Kirchoff et al. ..... 280/735
4,188,856 A 2/1980 Bendler et al.

(Continued)

FOREIGN PATENT DOCUMENTS

CA 2757634 A1 12/2010
CA 2772682 A1 5/2011

(Continued)

OTHER PUBLICATIONS

"International Application Serial No. PCT/US2012/041165, International Preliminary Report on Patentability mailed May 23, 2013", 26 pgs.

(Continued)

*Primary Examiner* — Len Tran
*Assistant Examiner* — Tuongminh Pham
(74) *Attorney, Agent, or Firm* — Schwegman Lundberg & Woessner, P.A.

(57) ABSTRACT

A fire suppression device includes a container body having a discharge orifice. A cooling assembly is coupled along an inner wall of the container body and includes a cooling housing body and an agent cup seat. An agent assembly coupled along the inner wall includes an agent cup with a fire suppression agent generator therein. An agent cup fitting is near an end of the agent cup and is coupled with the agent cup seat. Spacing members extend between the inner wall and at least one of the cooling housing body and the agent cup. The plurality of spacing members space the cooling housing body and the agent cup from the inner wall. An insulation layer is coupled between the inner wall and the plurality of spacing members, and a portion of the insulation layer is clamped between the spacing members and the inner wall.

9 Claims, 15 Drawing Sheets

(51) Int. Cl.

| | |
|---|---|
| ***A62C 5/00*** | (2006.01) |
| ***A62C 35/02*** | (2006.01) |
| *A62C 3/07* | (2006.01) |

(56) References Cited

U.S. PATENT DOCUMENTS

| | | | | |
|---|---|---|---|---|
| 6,116,348 | A * | 9/2000 | Drakin | 169/46 |
| 6,935,655 | B2 | 8/2005 | Longhurst et al. | |
| 7,614,458 | B2 * | 11/2009 | Gross | 169/43 |
| 7,814,838 | B2 * | 10/2010 | McCormick | 102/530 |
| 2010/0012335 | A1 * | 1/2010 | Popp | 169/46 |
| 2010/0230942 | A1 * | 9/2010 | Rose et al. | 280/736 |
| 2012/0067599 | A1 | 3/2012 | Guo et al. | |

FOREIGN PATENT DOCUMENTS

| | | | |
|---|---|---|---|
| DE | 19546526 | A1 | 6/1997 |
| JP | 2009160382 | A | 7/2009 |
| JP | 2011062341 | A | 3/2011 |
| WO | WO-2012170581 | A1 | 12/2012 |

OTHER PUBLICATIONS

"International Application Serial No. PCT/US2012/041165, International Search Report mailed Aug. 13, 2012", 4 pgs.

"International Application Serial No. PCT/US2012/041165, Written Opinion mailed Aug. 13, 2012", 10 pgs.

"European Application Serial No. 12796102.7, Office Action mailed Jun. 17, 2014", 1 pg.

"European Application Serial No. 12796102.7, Response filed Aug. 25, 2014 to Office Action mailed Jun. 17, 2014", 1 pg.

"Japanese Application Serial No. 2014-514607, Response filed Sep. 22, 2014 to Office Action mailed Jun. 24, 2014", (w/ English Translation of Claims), 10 pgs.

"European Application Serial No. 12796102.7, Extended European Search Report mailed May 30, 2014", 4 pgs.

"International Application Serial No. PCT/US2012/041165, Response filed Apr. 4, 2013 to Written Opinion mailed Aug. 13, 2012", 23 pgs.

"Japanese Application Serial No. 2014-514607, Office Action mailed Jun. 24, 2014", w/English translation, 5 pgs.

* cited by examiner

FIRE SUPPRESSION APPARATUS AND METHOD FOR USING THE SAME IN AN ENCLOSED COMPARTMENT

CLAIM OF PRIORITY

This patent application is a U.S. National Stage Application filed under 35 U.S.C. 371 of International Application No. PCT/2012/041165, filed Jun. 6, 2012, which claims the benefit of priority, under 35 U.S.C. Section 119(e), to Gross et al., U.S. Provisional Patent Application Ser. No. 61/493,856, entitled "FIRE EXTINGUISHING APPARATUS AND METHOD FOR USING THE SAME IN AN ENCLOSED COMPARTMENT," filed on Jun. 6, 2011, which are hereby incorporated by reference herein in their entireties.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Fireaway, LLC; Minneapolis, Minn. All Rights Reserved.

TECHNICAL FIELD

This document pertains generally, but not by way of limitation, to fire suppression and fire extinguishing systems and methods.

BACKGROUND

Self contained fire extinguishing assemblies are used to extinguish fires in enclosed volumes. In some examples, the assemblies are mounted within the enclosed volumes (rooms, warehouses and the like). In other examples, the assemblies are mounted in locations that experience sometimes violent movement, vibration and the like including, for instance, engine compartments, equipment cabinets and the like.

Dynamic forces caused by violent movement and vibration (e.g., from crashes, vehicle or equipment operation and the like) are applied to the fire extinguishing assemblies and may damage components therein. Damage to fire extinguishing assemblies causes the assemblies to fail or not perform adequately when needed in the desired environment (e.g., during a fire in an engine compartment).

In other examples, dynamic forces as described above alter the arrangement of components of the fire extinguishing assemblies as manufactured and accordingly may negatively affect the performance of the assemblies.

OVERVIEW

The present inventors have recognized, among other things, that a problem to be solved can include mechanically supporting a fire extinguishing assembly configured for mounting in a dynamic environment, including for instance an engine compartment. In an example, the present subject matter can provide a solution to this problem, for instance by anchoring and supporting the components of a fire suppression device. As described herein an agent cup is seated within a cooling housing body of a cooling assembly. Spacing members are provided that extend between the container body inner wall of the device and one or more of the agent cup and the cooling housing body. In one example, the spacing members provide a clamping engagement with a deformable insulation layer interposed between the container body inner wall and one or more of the agent cup or the cooling housing body. The localized deformation of a portion of the resilient insulation layer firmly fixes the cooling housing body and the seated agent cup in place (e.g., laterally and axially relative to the container body). Additionally, the engagement of the agent cup and the cooling housing body with the insulation layer provides a shock absorbing shell to at least the fire suppression agent generator that substantially prevents cracking, pulverizing and the like of the generator.

Furthermore, the localized compression of a portion of the insulation layer maintains the remainder of the insulation layer (e.g., a large majority) in an uncompressed state that allows the insulation layer to insulate the components of the device (e.g., the fire suppression agent generator, ignition components within the device, and the like) from high and low temperatures within a compartment that may negatively affect the function of the device over time, for instance from cyclical heating and cooling. Stated another way, the insulation layer will slow otherwise rapid changes in temperatures.

Further still, the coupling of the agent cup with the cooling housing body forms a robustly supported assembly that ensures both components are supported and centered within the container body. For instance, as described above, the spacing members (clamping the insulation layer) support and center the cooling assembly including the cooling housing body. By seating the agent cup with the cooling housing body the spacing members extending from the cooling housing body correspondingly also center and support the agent cup and the fire suppression agent generator therein. In another example, the agent cup includes spacing members alternatively or in addition to the spacing members of the cooling housing body. For instance, the agent cup includes a cup flange (e.g., dimples) that provides a clamping engagement with the insulation layer in a similar fashion to the spacing members of the cooling housing body.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
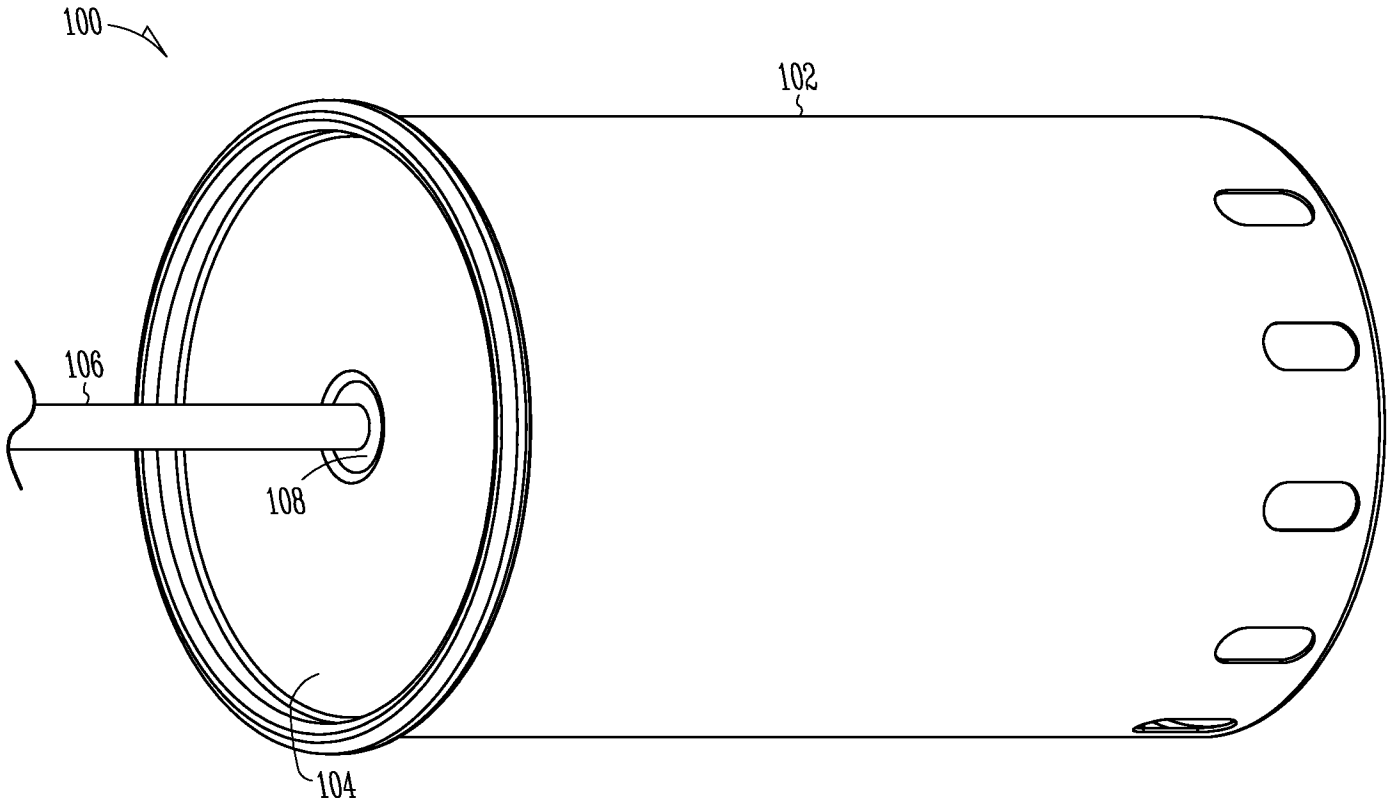
FIG. 1 is a perspective view of an example of a fire suppression device.

FIG. 1 shows one example of a fire suppression device 100 (e.g., a fire extinguishing device or a suppressive device configured to bring a fire under control) for use in enclosed compartments, for instance, an engine compartment. As shown, the fire suppression device 100 includes a container body 102 having an enclosure cap 104 at one end of the container bottom 102. An ignition assembly 106 extends into the container body 102, for instance, through a fitting 108, such as a potted fitting. In one example, the ignition assembly 106 includes, but is not limited to, an ignitable cord, flammable substances, a thermal and mechanical ignition system that is triggered by reaching a specified temperature that cause a portion of the system to deform or melt and release a firing pin or by mechanical operation for instance the pulling of a pin or strip that release the firing pin and the like. The specified temperature for the deformable portion of the system includes a range of temperatures from around 150 degrees Fahrenheit to 500 degrees Fahrenheit or greater. In another example, the ignition assembly 106 includes, but is not limited to, an electrical wire (e.g., at least a pair of wires) received within the container body 102 and configured to ignite an aerosol generating pellet within the container body 102 when electricity is applied. Optionally, the fitting 108 is formed in a depression provided within the enclosure cap 104 to substantially anchor the ignition assembly 106 to the container body 102. In one example, the fitting 108 includes an epoxy deposited within the depression and substantially isolated from the interior of the container body 102 including, for instance, a cooling bed and an aerosol generating substance or pellet contained within the container body 102. Optionally, the container body 102 includes open ends at one or both ends of the body. With an open end at both ends of the container body enclosure caps 104 are used to close the fire suppression device 100.

Figure 2:
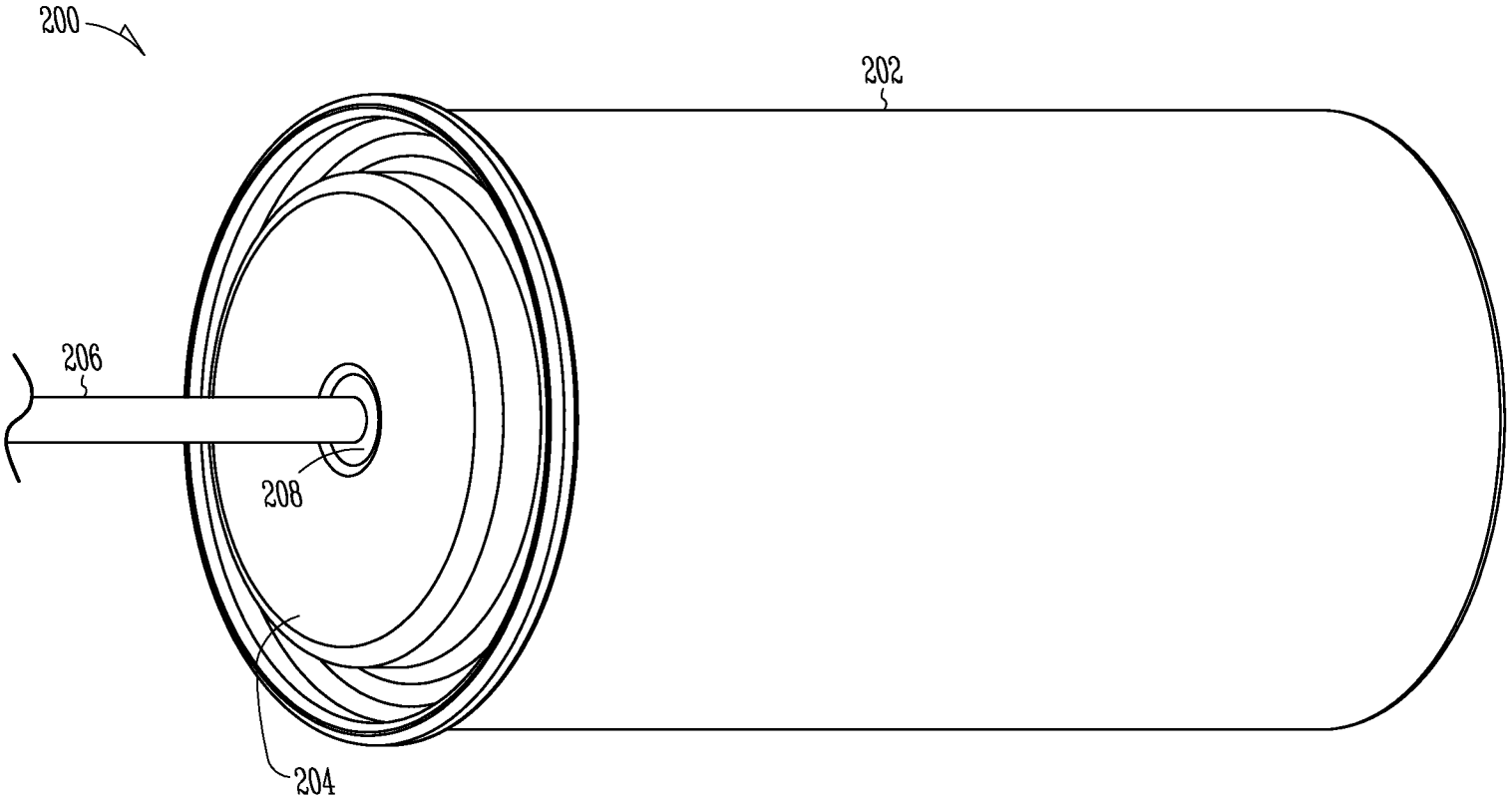
FIG. 2 is a perspective view of another example of a fire suppression device.

FIG. 2 shows another example of a fire suppression device 200 configured for use in an enclosed compartment, such as an engine compartment. In the examples shown in FIGS. 1 and 2 and further described herein, the fire suppression devices 100, 200 while described for use in an enclosed compartment are also configured for use in open or relatively open spaces, such as rooms, confined spaces, open rooms including fenestration units such as windows, doors and open spaces such as public common areas inside or outside of buildings. For instance, the fire suppression devices 200 are configured for use within or on equipment cabinets (e.g., pump, compressor, fan, server housings or cabinets and the like).

As shown in FIG. 2, the fire suppression device 200 includes a container body 202 and an enclosure cap 204 positioned at one end of the container body 202 to enclosed the contents of the fire suppression device 100 therein. As further shown in FIG. 2, the enclosure cap 104 includes a depression near the container body 102 outer wall. In one example, the enclosure cap 104 is coupled with the container body 102, for instance, by spinning of the cap with the container body 102 to fasten the enclosure cap 104 to the container body 202. In another example, the enclosure cap 104 shown in FIG. 1 is fastened to the container body 102 by rolling of the edges of the enclosure cap 104 along the container body 102 to fasten the enclosure cap 104 thereon. Referring again to FIG. 2, the fire suppression device 200 is shown with ignition assembly 206 extending into and through the enclosure cap 104 through a fitting 208, such as a potted fitting. As previously described, the fitting 208 anchors the ignition assembly 206 while the potting of the fitting 208 (e.g., an epoxy or the like) is otherwise isolated from the interior components of the fire suppression device 200, including but not limited to, a cooling bed and an aerosol generating pellet disposed therein.

In another example, the container body and components of the fire suppression devices 100, 200 are constructed with metals, polymers, composites and the like including but not limited to steels, aluminum, composites and plastics. The fire suppression devices 100, 200 described herein, are in one example, usable as a component in fire protection system incorporated within a compartment housing part or the substantial entirety of one or more engines, compressors, pumps, servers and the like. In one example, the fire suppression devices 100, 200 provide a directed stream, cloud and the like of aerosol fire suppression agent for an engine compartment. The aerosol fire suppression agent is configured to suppress or extinguish fires and fire hazards within the engine compartment and at features and components adjacent to the engine compartment.

Figure 3:
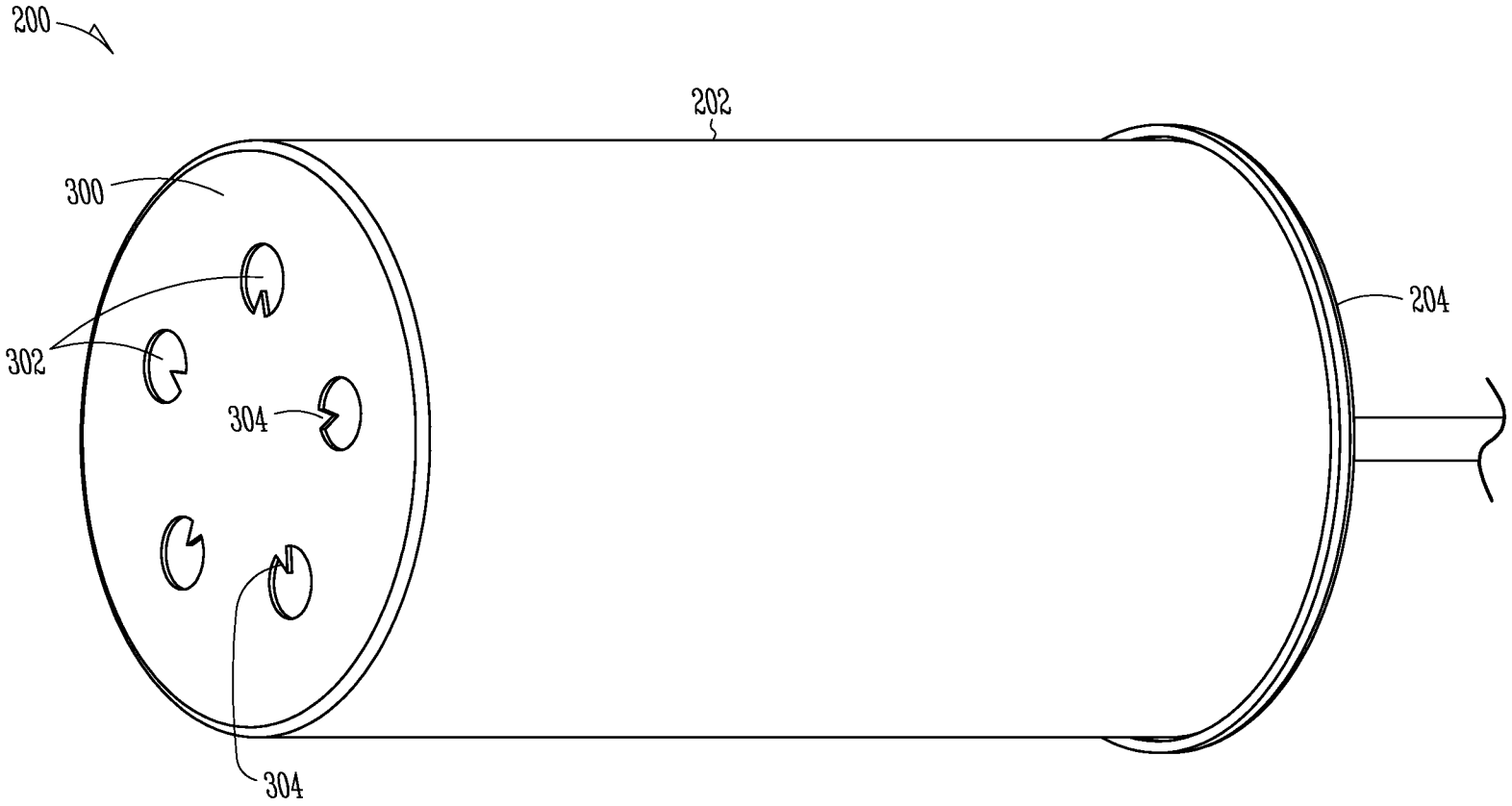
FIG. 3 is a perspective view of a discharge end of the fire suppression device shown in FIG. 2.

Referring now to FIG. 3, the fire suppression device 200 including the container body 202 is shown again in perspective with the discharge end 300 shown. In one example, the discharge end 300 includes a front end of the fire suppression device 200. As shown, the discharge end 300 includes a face (planar, concave, convex, conical, faceted and the like) having a plurality of discharge orifices 302 positioned at varying positions around the discharge end 300. For instance, the discharge orifices 302 are arranged in a circular pattern around the discharge end 300 according to the number of discharge orifices 302 included. In the example shown in FIG. 3, five discharge orifices 302 are included with the fire suppression device 200. In another example, greater or fewer discharge orifices 302 are included with the fire suppression device 200.

Referring again to FIG. 3, the discharge orifices 302 are shown with one or more projections 304 extending into the interior of the discharge orifices 302. For instance, as shown in FIG. 3, the plurality of projections 304 each extend into the interior of the space within the discharge orifices 302. The plurality of projections 304 are configured to enhance the turbulence of a fire suppression agent generated by a fire suppression agent generator (e.g., an aerosol pellet) within the container body 202. As the fire suppression agent is generated it is delivered through the plurality of discharge orifices 302 for instance, the axially directed discharge orifices 302 shown in FIG. 3. The projections 304 extending into the discharge orifices 302 partially interrupt the flow of the agent and provide enhanced turbulence to the discharging fire suppression agent. The enhanced turbulence rapidly cools the fire suppression agent and correspondingly creates a finer particulate within the aerosol. Rapid condensing of the aerosol particles is controlled with the turbulence enhanced cooling.

Figure 4A:
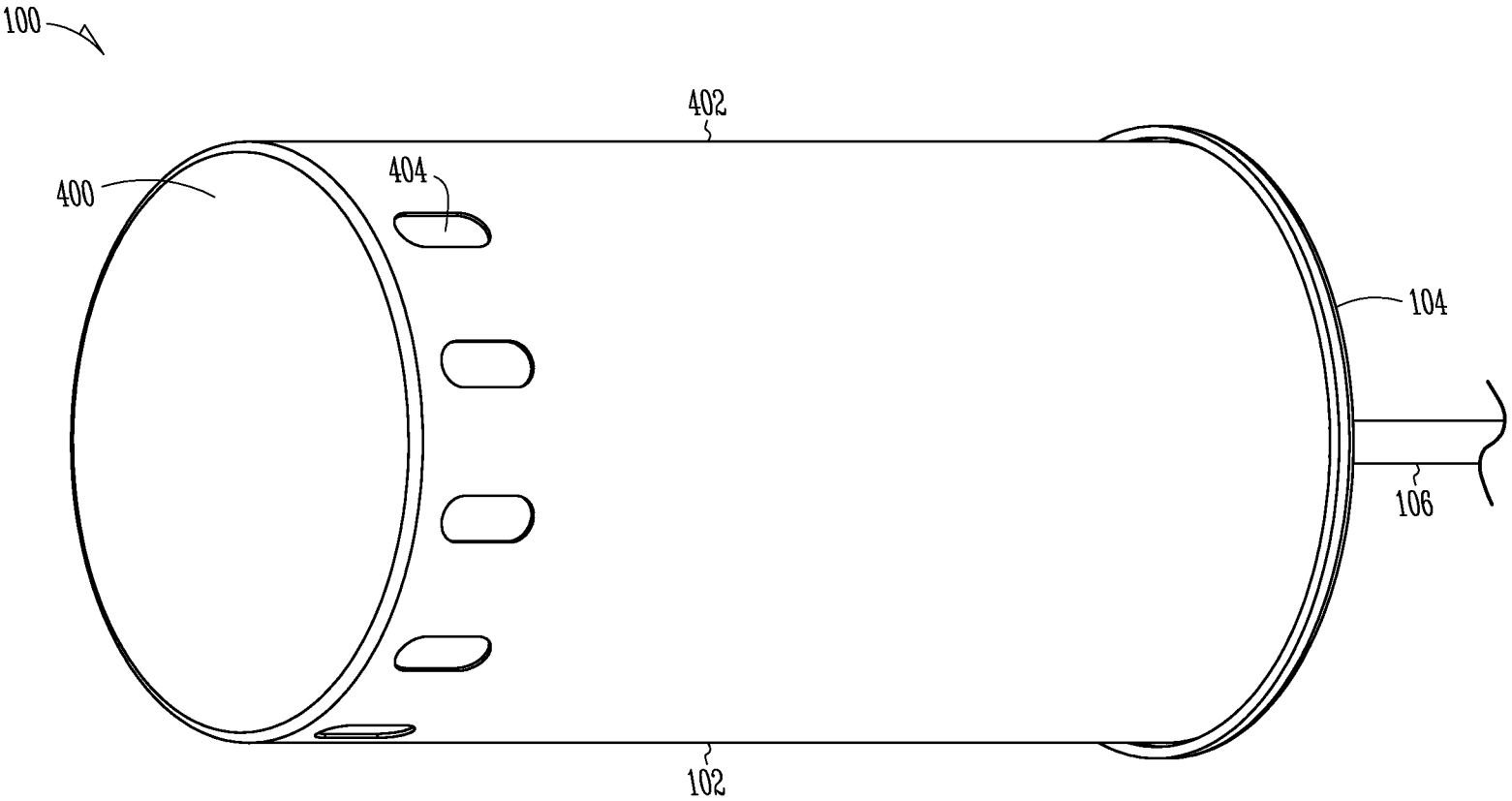
FIG. 4A is a perspective view of a discharge end of the first exemplary fire suppression device shown in FIG. 1.

FIG. 4A is a perspective view of the discharge end of the fire suppression device 100 previously shown in FIG. 1. As shown, the container body 102 includes a container side wall 402 and a discharge end 400. A plurality of radially or partially radial discharge orifices 404 are formed around the container side wall 402. In the example shown in FIG. 4A, the plurality of discharge orifices 404 are ranged around the perimeter of the container body 102. In another example, the plurality of discharge orifices 104 are positioned around a portion of the container side wall 402. For instance, the plurality of discharge orifices 404 are formed along a portion of the perimeter measuring approximately 270 degrees or less. The plurality of discharge orifices 404 in another example are formed in the container side wall 402 along a portion of the perimeter measuring approximately 180 degrees or less. With the plurality of discharge orifices 404 formed on all or a portion of the container side wall 402 the fire suppression device 100 is configured to provide a corresponding stream of fire suppression agent delivered in a manner corresponding to the number and position of the plurality of discharge orifices 404. For instance, where a plurality of discharge orifices 404 are positioned around only a portion of the container side wall 402, for instance along a perimeter angle measurement of approximately 180 degrees, the fire suppression agent is generated in a corresponding hemispherical pattern away from the container body 102 (e.g., the aerosol is directed as needed into a compartment and as controlled by the orifices 404). Optionally, the discharge orifices 404 include the turbulence inducing projections 304 described herein.

Figure 4B:
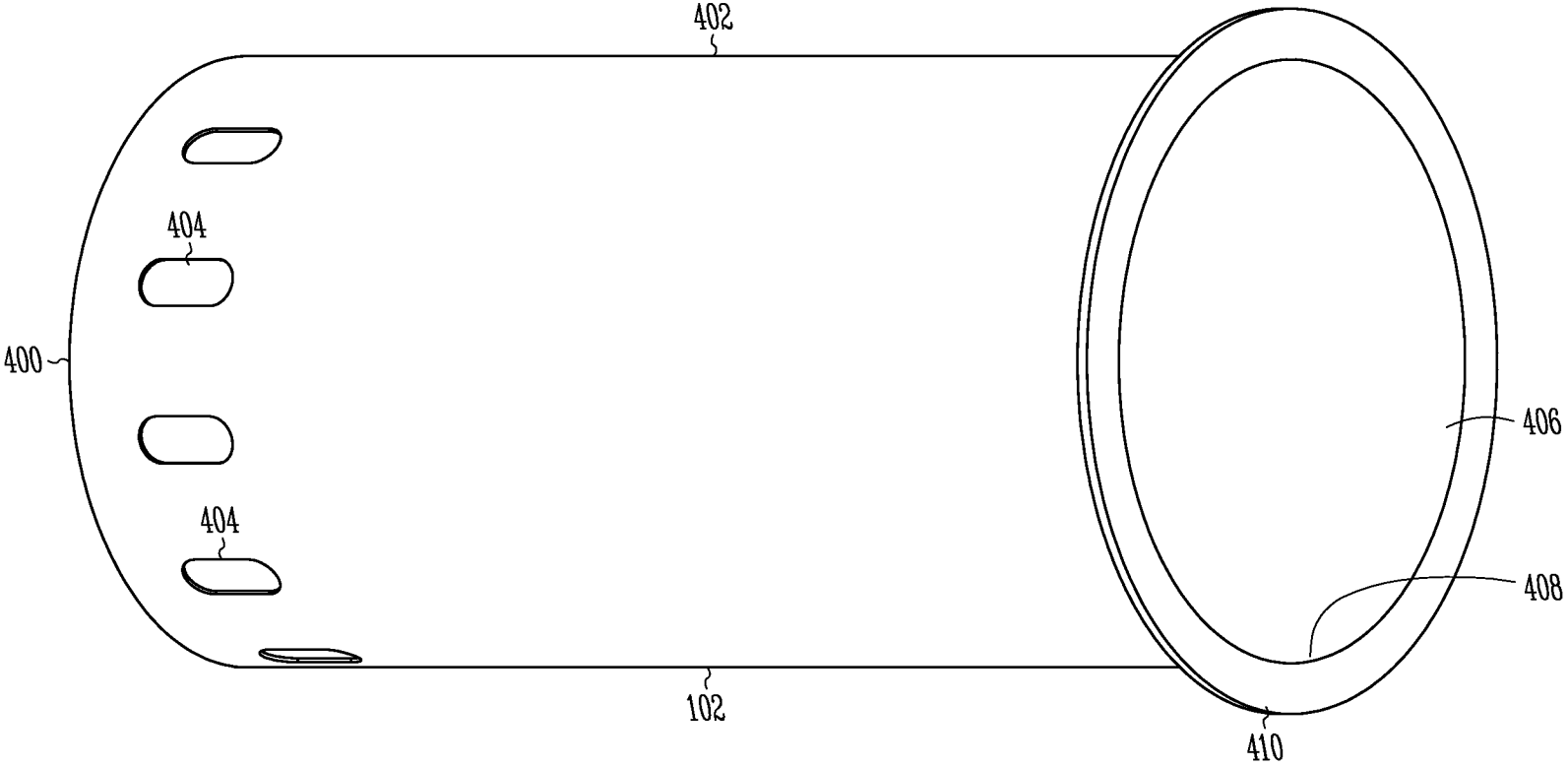
FIG. 4B is a perspective view of the open container body of the first exemplary fire suppression device shown in FIG. 1.

FIG. 4B shows another example of the container body 102 in a prefinished configuration without the enclosure cap 104 included thereon. As shown the container body 102 includes the container sidewall 402 with the plurality of discharge orifices 404 formed in the container sidewall 402. The container body 102 further includes the installation opening 406 for installation and positioning of the inner components of the fire suppression device 100 (the components of the fire suppression device 200 are similarly installed). The installation opening 406 exposes the interior of the container body 102 and shows a container inner wall 408. As shown in FIG. 4B, the container inner wall 408 ends at an installation flange 410 to configure to receive a portion of the enclosure cap 104. Enclosing of the fire suppression device 100 is desired, for instance, after installation of the fire suppression agent generator and the cooling bed. As will be described in further detail below, the components of the fire suppression device 100 (and 200) when installed along the interior of the container inner wall 408 are spaced from the inner wall and robustly supported in a centered configuration within the container body 102. The central positioning of the interior components substantially prevents crushing of insulation interposed between the components and the container inner wall 408 while the insulation cooperates with the components (e.g., dimples, projections, tabs, projections and the like) to securely and robustly support the components against vibration, mechanical shock and the like.

Figure 5A:
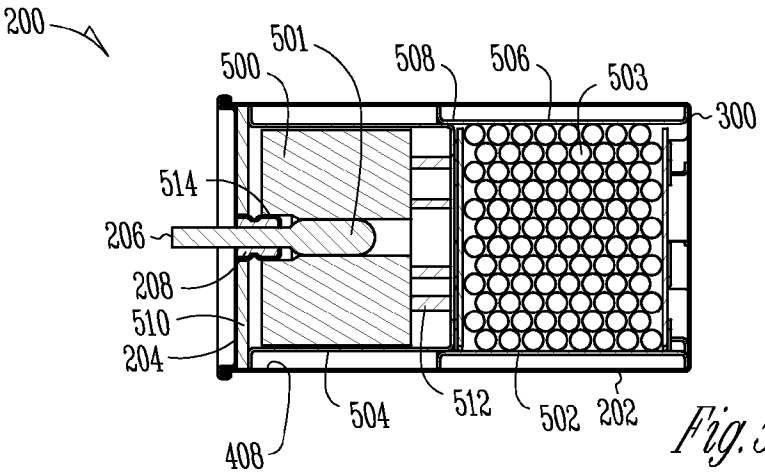
FIGS. 5A-E are views of the second exemplary fire suppression device shown in FIG. 2.
Figure 5D:
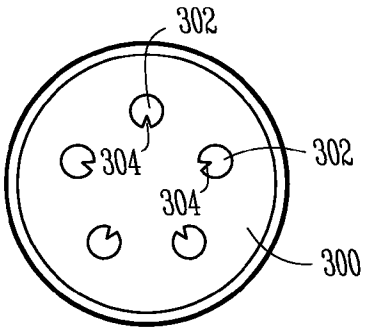
Figure 5C:
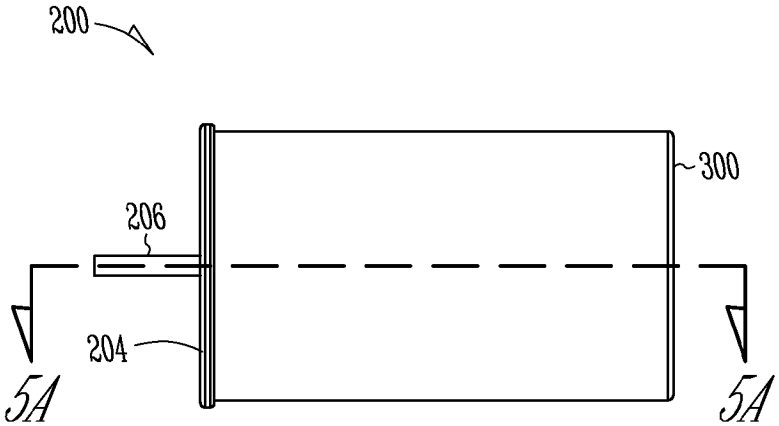
Figure 5E:
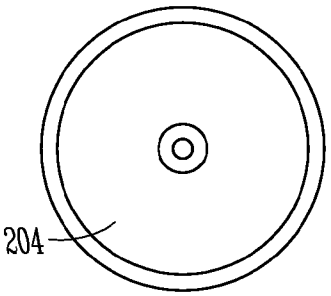
Figure 5B:
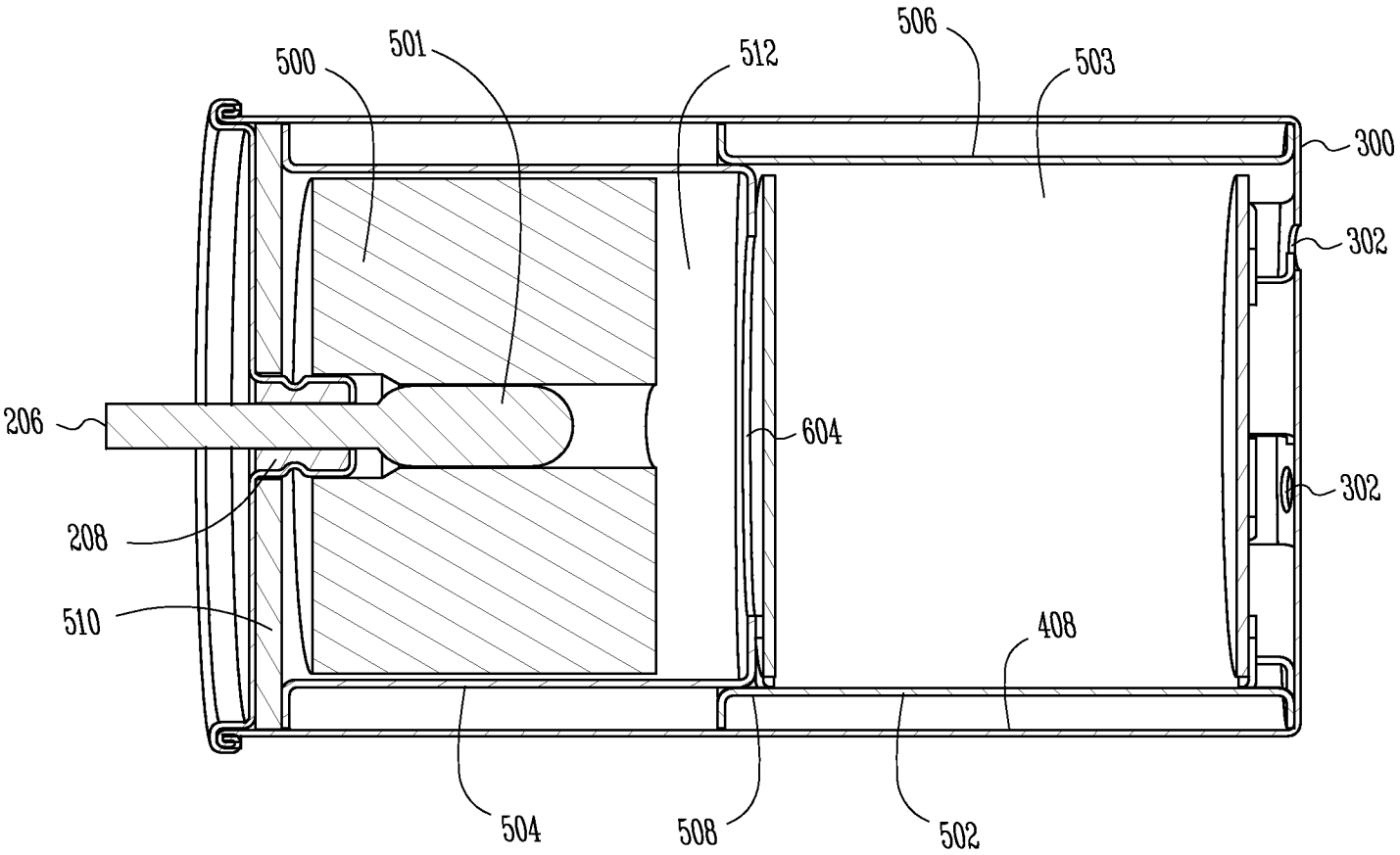

FIGS. 5A through 5C show the fire suppression device 200 (FIG. 3) in varying cross sectional, end and side views. Referring to FIGS. 5A and 5B, the fire suppression device 200 is shown in cross section (a cross section in perspective is provided in FIG. 5B). The container body 202 includes a fire suppression agent generator 500, for instance an aerosol generating fire suppression pellet capable of generating an aerosol having fire suppressing particulate matter therein. The fire suppression agent generator 500 is disposed within an agent cup 504 within the container body 202 (seated and supported as described herein).

The fire suppression device 200 further includes a cooling assembly 502 positioned adjacent to the fire suppression agent generator 500. As shown, the cooling assembly 502 is provided with a cooling housing 506 positioned for close abutting engagement with the agent cup 504 with the fire suppression agent generator 500 therein. As shown in FIG. 5A, the cooling housing 506 includes cooling media 503, for instance, a plurality of cooling media pieces 503 including but not limited to pumice stone, activated alumina, zeolite, ceramics, crushed rock such as marble, perforated metal, ceramic particles or plates, and the like. The cooling assembly 502 will be further described in detail below.

As shown again in FIGS. 5A and 5B, the cooling assembly 502 includes a cup seat 508 sized and shaped to receive a portion of the agent cup 504 therein. Each of the agent cup 504 and the cooling assembly 502 includes flanges, ridges, projections and the like sized and shaped to snuggly engage and position the fire suppression agent generator 500, the agent cup 504, the cooling housing 506, as well as the cooling media 503 within the container body 202. Stated another way, the respective components are snuggly received and engaged with the container inner wall 408 to substantially prevent the relative movement of, for instance, the fire suppression agent generator 500 and the cooling media 503 relative to the other components of the fire suppression device 200.

Optionally, as shown in FIGS. 5A and 5B a pressure pad 510 (e.g., a ceramic insulating material in one example) is provided between the enclosure cap 204 and the agent cup 504. The pressure pad 510 snuggly positions the agent cup 504, the fire suppression generator 500 therein, as well as the cooling housing 506 and the cooling media 503 axially within the container body 202. Further, in another example a spacer 512 is provided within the agent cup 504 between the fire suppression agent generator 500 and the bottom most portion of the agent cup 504. The bottom portion of the agent cup 504 includes orifices (see feature 604) therethrough allowing transmission of fire suppression agent 500 from the agent cup 504 into the cooling assembly 502 for eventual delivery through the plurality of discharge orifices 302, for instance shown in FIG. 5C. The combination of the pressure pad 510, agent cup 504 and the cooling housing 506 snuggly engages and statically holds the components of the fire suppression device 200 within the container body 102. For instance, as shown the agent cup 504 (as well as the generator 500) and the cooling housing assembly 502 having the cooling media 503 are spaced from the container inner wall 408 by the flanges and features of the agent cup 504 and the cooling housing 506. The spacing provided centrally positions the fire suppression agent generator 500 and the cooling media (as well as the adjacent cup and housing) and correspondingly isolates the components from exterior temperatures and dynamic forces (such as vibration and shock after installation), for instance from vehicle crashes, high (non-fire) temperatures and the like.

As will be described in further detail herein, the spacing also facilitates the interposing of an insulation layer between both the agent cup 504, the cooling housing 506 and the container inner wall. The insulation layer is tightly sandwiched with point loads (at dimples, tabs, projections and the like) that correspondingly axially and longitudinally fix the agent cup 504 and the cooling housing 506 within the container body 202 while at the same time leaving the large majority of the insulation layer intact and uncompacted.

The fire suppression agent generator 500 previously described herein includes but is not limited to compounds which generate inert gases, inert gas compounds having combinations of inert gases and solid particulate or the like. One option for the fire suppression agent generator 500 includes a compound having potassium carbonate. In another example, the fire suppression agent generator includes a compound having an oxidizer such as an alkali nitrate and additives such as dicyandiamide and a combustive binder such as a phenol-formaldehyde resin. The compound is produced in one example by dissolving the resin in a liquid and then mixing the oxidizer and the additive.

Referring again to FIG. 5A, a potting depression 514 is shown formed in the enclosure cap 204. The potting depression 514, in one example is a depressed metal fitting formed in the enclosure cap 204 to facilitate the reception of the fitting 208 (e.g., a potting fitting) such as an epoxy therein to anchor the ignition assembly 206 within the fire suppression device 200. As shown, the potting depression 514 substantially isolates the fitting 208 (e.g., a wire seal) relative to the other components of the fire suppression device, including but not limited to, the fire suppression agent generator 500 and the cooling assembly having the cooling media 503 therein. As further shown in FIG. 5A, the ignition assembly 206 includes an igniter 501 positioned within the fire suppression agent generator 500. The igniter 501 is configured to initiate the generator according to an ignition signal (e.g., voltage), burning of the ignition assembly 206 and the like.

Figure 6A:
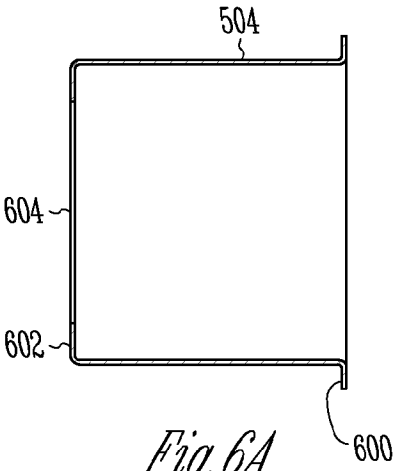
FIGS. 6A-D are views of one example of an agent cup for retaining a fire suppression agent.
Figure 6B:
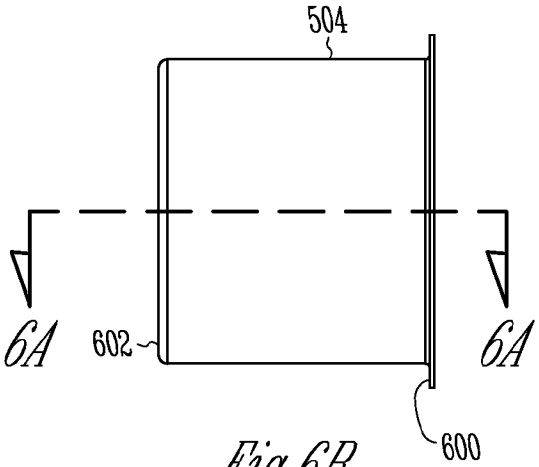
Figure 6C:
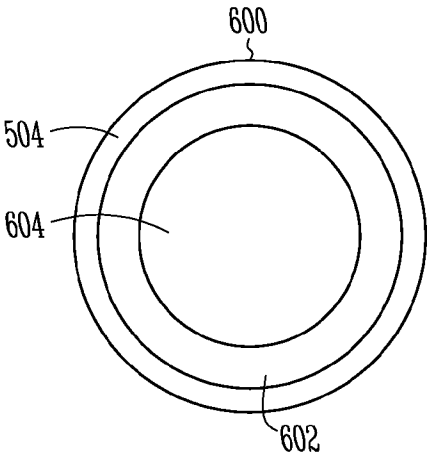
Figure 6D:
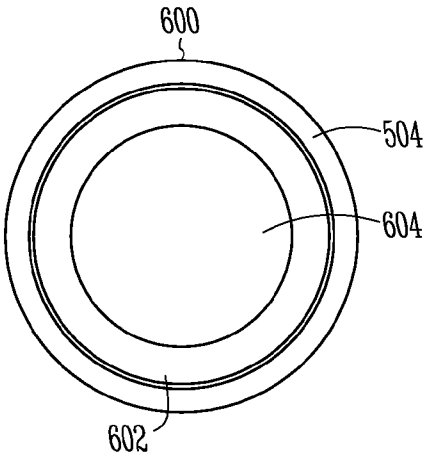

FIGS. 6A and 6B show respective views of the agent cup 504 shown previously in FIGS. 5A and 5B. As shown, the agent cup 504 is sized and shaped to receive the fire suppression agent generator 500 shown in FIGS. 5A and 5B. As shown in FIG. 6A, the agent cup 504 includes a cup installation flange 600 sized and shaped for snug reception within the container body 202. The cup installation flange 600, in one example, assists in spacing, supporting and isolating the remainder of the agent cup 504 and the generator 500 from the container body 202, as described herein. Further, the agent cup 504 includes at an opposed end, a cup fitting 602 sized and shaped for reception within the cup seat 508 of the cooling housing 506. As previously described, the engagement of the cup fitting 602 within the cup seat 508 snuggly positions the agent cup 504 relative to the cooling housing 506 and allows for the static positioning of both components within the fire suppression device 200. As further shown in FIG. 6A, a cup discharge orifice 604 is provided for delivery of the fire suppression agent from within the agent cup 504 to the cooling assembly 502 shown in FIGS. 5A and 5B.

Figure 7A:
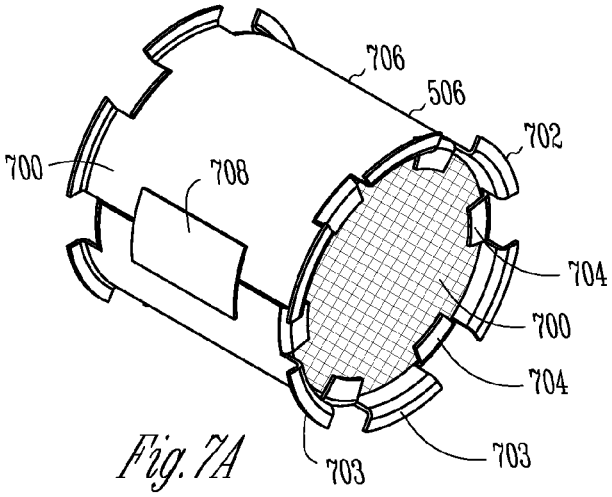
FIGS. 7A-D are views of one example of a cooling housing body used in a cooling assembly.
Figure 7B:
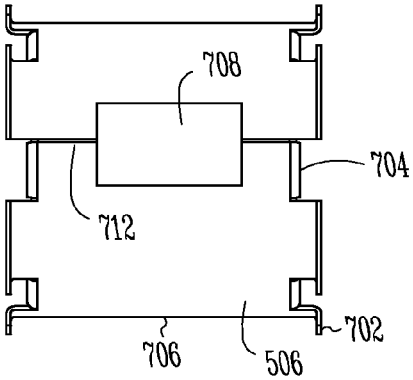
Figure 7C:
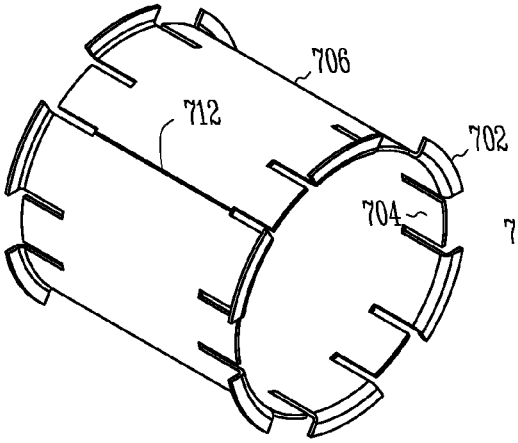
Figure 7D:
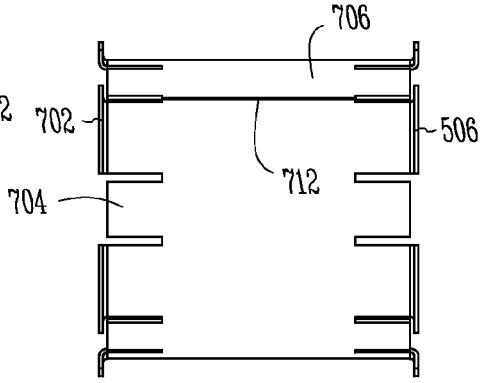

FIG. 7A-7D show various view of the cooling housing 506 previously shown and described in FIGS. 5A-5C. FIGS. 7A, B are respective perspective and side views of the cooling housing 506 after installation of screens 700. FIGS. 7C, D are respective perspective and side views of the cooling housing prior to installation of the screens 700. As shown, the cooling housing 506 includes a housing body 706 including a plurality of legs 702 and retaining tabs 704. As shown in FIG. 7C, the plurality of legs 702 and retaining tabs 704 are oriented in a similar direction (e.g., along the body longitudinal axis) prior to installation of the screens 700. Referring now to FIG. 7A, two screens 700 are positioned at opposing ends of the cooling housing 506. The screens 700 bracket cooling material, such as the cooling media 503 shown in FIG. 5A, within the cooling housing 506 and cooperate with the plurality of containing tabs 704 to retain the cooling media 503 therein.

In one example, the plurality of retaining tabs 704 at one end are inwardly bent or formed as shown in FIG. 7A. One of the screens 700 is thereafter installed from an opposing end of the cooling housing body 706 and positioned at rest on top of the corresponding retaining tab 704. The cooling housing body 706 is thereafter filled with the cooling media 503. The retaining tabs 704 at the other end of the cooling housing body 706 are thereafter deflected after positioning of an opposed screen 700 on top of the cooling media 503. Deflection of the retaining tabs 704 positions the retaining tabs 704 at the opposed ends over the installed screens 700 to thereby substantially fix the cooling media 503 within the cooling housing body 706. As shown in FIGS. 7A and 7B, the legs 702 remain in their position extending away from the remainder of the cooling housing 706. The flanges 703 presented on each of the legs 702 provide for a snug engagement of the cooling housing body 706 and the entire cooling assembly 502 within the container body 202 as shown in FIG. 5A. As described herein in another example, the flanges 703 sandwich an insulation layer between the flanges 703 and the container inner wall 408 (see FIG. 4) to deform the underlying insulation layer and thereby snugly anchor the cooling housing 506 (and seated agent cup 504) within the container body 202. The large majority of the insulation layer not deformed between the flanges 703 and the container inner wall 408 is not crushed and continues to provide the desired insulative properties to the fire suppression device 100 (and 200). In contrast, without the insulation layer sandwiched therebetween a gap that allows for installation is provided between the cooling housing 506 and the container inner wall 408 that allows for vibration and transmission of dynamic forces to the cooling housing 506, the cooling media 503 and the fire suppression agent 500 in the agent cup 504 seated within the cooling housing 506. Optionally, the agent cup 504 includes projections alternatively or in addition to the flanges 703 described herein. Where the agent cup 504 includes the projections and the cooling housing 506 does not the projections on the agent cup 504 center and support both the cup and the cooling housing in a manner substantially the same as the flanges 703 on the cooling housing 506. In another options, the projections, flanges, ridges and the like that provide the spacing, support and centering described herein are a single or unitary feature including, but not limited to, an annular ridge or projection whether continuous or discontinuous, a ring (continuous or discontinuous) and the like. A reference to one or more or a plurality of projections, flanges or ridges accordingly includes reference to a single projection, flange, ridge or the like.

In the example shown in FIGS. 7A-D, at least the legs 702 at one end of the cooling housing body 706 provide the cup seat 508 shown in FIG. 5A for reception of the cup fitting 602 shown in FIG. 6A. The cooling housing body 706 thereby cooperates with the agent cup 504 to snuggly position both of the corresponding components within the fire suppression device 200. The interposing of a deformable insulation layer therebetween further anchors and supports the components. Although reference has been made to the fire suppression device 200 as described herein each of the components described in the figures herein is fully applicable and usable within the fire suppression device 100.

Referring again to FIGS. 7A and 7B, the cooling housing body 706 is provided with a welding tab 708. In one example, the cooling housing body 706 is formed from a substantially flat piece of material prior to rolling into the cylindrical shape shown in FIGS. 7A-7D. Upon rolling of the cooling housing body 706 into the shown cylindrical shape the welding tab 708 is provided across the seams 712 to facilitate the coupling of the opposed ends of the cooling housing body 706 and thereafter fix the cooling housing body 706 in the desired cylindrical configuration complementary to the inner perimeter of the container body 202 (e.g., with a smaller diameter).

One method of making one or more of the fire suppression devices 100, 200 is provided below. In a first step, a tube is drawn to form one or more container bodies 102, 202. The cooling assembly, such as the cooling bed assembly 502, is thereafter installed within the drawn tube (e.g., container bodies 102, 202). For instance, as shown in FIG. 5A, the cooling assembly 502 is slid into the container body 202. The agent cup 504 including the fire suppression agent generator 500 is thereafter installed within the container body 202. For instance, the cup fitting 602 shown in FIG. 6A is positioned within the cup seat 508. In one example, a pressure pad, such as the pressure pad 510, is installed over top of the agent cup 504 along a cup installation flange 600. The enclosure cap (e.g., top plate) is thereafter positioned over top of the agent cup 504 and the cooling assembly 502 (optionally the pressure pad 510) and fastened with the container body 102, 202. In one example, prior to fastening of the enclosure cap 204 with the container body 102, 202 the ignition assembly 206 is fed into the fire suppression agent generator 500. The enclosure cap 204 is thereafter fed over the ignition assembly 206 and then fastened to the container body 102, 202. The ignition assembly 206 is potted within the potting depression 514 formed in the enclosure cap 204 with the fitting 208 (see FIG. 2). For instance, a wire seal, such as an epoxy is positioned within the potting depression 514 to substantially fix the ignition assembly 206 therein. Optionally, the ignition assembly is preinstalled with the enclosure cap 204 prior to coupling of the cap with the container body 102, 202. The enclosure cap 204 and the ignition assembly 206 are installed as an assembly thereby avoiding assembly of the cap and the ignition assembly while forming the fire suppression device 100, 200.

Figure 8:
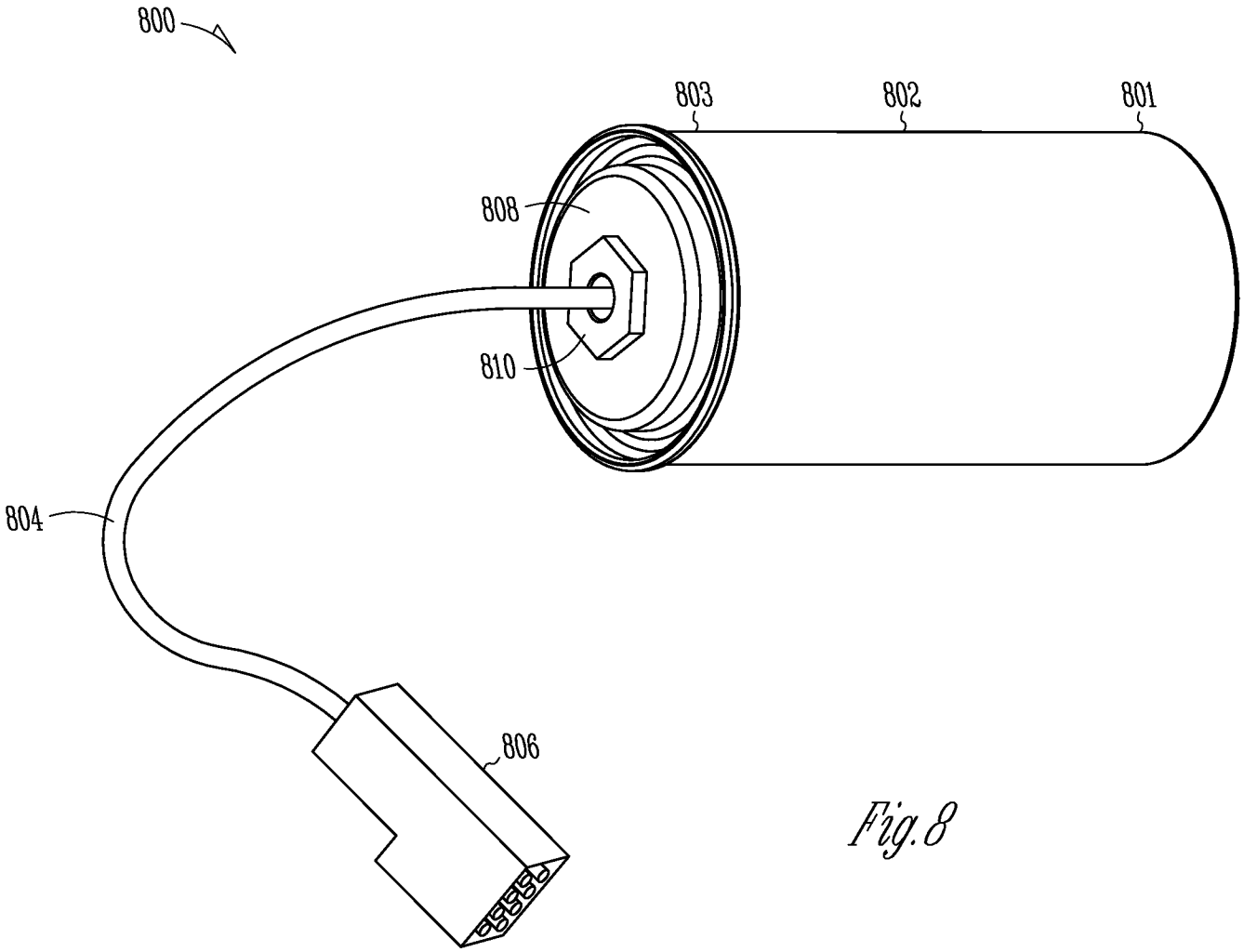
FIG. 8 is a perspective view of another example of a fire suppression device.

FIG. 8 shows another example of a fire suppression device 800. The fire suppression device 800 is in at least some respects similar to the previously described fire suppression devices 100, 200. For example, the fire suppression device 800 includes a first end, for instance a discharge end 801 (having discharge openings similar to the opening previously shown herein), and a second end 803, such as an ignition end sized and shaped for coupling with an ignition assembly 804 as shown in FIG. 8. The fire suppression device 800 includes a container body 802 having a similar design to the container bodies 102 and 202. As shown in FIG. 8, an enclosure cap 808 closes the container body 802 thereby holding the components of the fire suppression device 800 therein. The enclosure cap 808 in combination with the container body inner wall of the container body 802 cooperates with the features and elements within the container body 802 to snuggly and securely position the components of the fire suppression device 800 and substantially prevent the damage of the components therein, for instance, by the transmission of dynamic forces or vibration of those components (e.g., while the fire suppression device is in a compartment of a vehicle driving down a rough road).

Referring again to FIG. 8, the ignition assembly 804 is shown extending from an ignition assembly fitting 810 coupled with the enclosure cap 808. In one example, the ignition assembly 804 includes a wired assembly having an ignition assembly connector 806 such as a plug or socket sized and shaped to couple with a system such as a flame or smoke detection system, temperature detection system, impact or crash detection system and the like. In another example, the ignition assembly 804 is without the wire harness shown in FIG. 8, for instance, the ignition assembly 804 includes a plug or socket at the ignition assembly fitting 810 sized and shaped for direct coupling with any of the systems described above.

Figure 9:
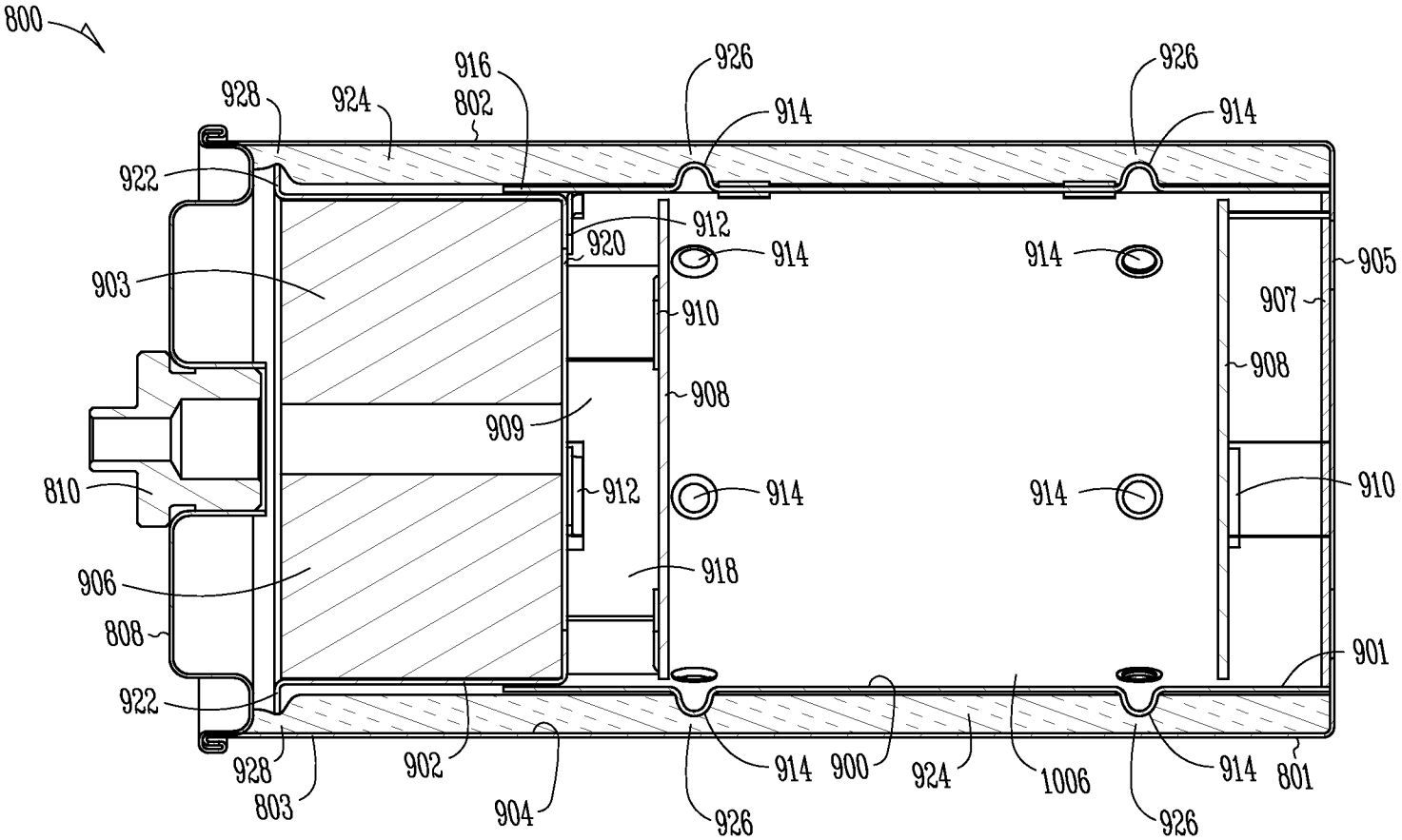
FIG. 9 is a cross sectional view of the fire suppression device shown in FIG. 8.

FIG. 9 shows the fire suppression device 800 of FIG. 8 in cross-section. The fire suppression device 800 includes a cooling housing body 900 and an agent cup 902 both positioned within the container body 802. As will be described in further detail below, features of one or more of the cooling housing body 900 and the agent cup 902 allow for the robust support and positioning of the housing body 900 and the agent cup 902 within the container body 802. The support and anchoring (e.g., clamping) of these components within the fire suppression device 800 secures these elements therein and thereby correspondingly supports and protects features such as the fire suppression agent generator 906 shown in FIG. 9.

Referring again to FIG. 9, the cooling housing body 900 is, in one example, part of a cooling assembly 901. In one example, the cooling assembly 901 includes the cooling housing body 900 as well as a cooling media such as crushed marble disposed therein (or any of the other cooling media materials described herein). As shown in FIG. 9, in one example, the cooling housing body 900 includes screen supports 910 at either end of the cooling housing body 900 sized and shaped to receive and support screens 908. The screens 908 allow the passage of gasses, such as a fire suppression aerosol generated by the fire suppression agent generator 906, therethrough prior to discharge through the discharge orifices 905. In one example, the screens 908 include, but are not limited to, metals, such as stainless steel, carbon steel or the like. For instance, the screens 908 include wire screens having a substantially circular perimeter sized and shaped for reception within the cooling housing body 900, as shown in FIG. 9.

As further shown in FIG. 9, the agent cup 902 forms a portion of an agent assembly 903. In one example, the agent assembly 903 includes the agent cup 902 as well as the fire suppression agent generator 906. As previously described herein, the fire suppression agent generator 906 is, in one example, a pellet or cake of combustible material configured to generate an aerosol of fire suppression agent that is generated adjacent to the fire suppression agent generator 906, for instance in a combustion chamber 918 formed between the agent cup 902 and the cooling housing body 900 as described herein. The fire suppression aerosol is delivered through an agent cup orifice 909 to the cooling media positioned within the cooling housing body 900 (the cooling media is shown in other figures herein, such as FIG. 5A) and thereafter passes through the screen 908 near the first end 801 of the container body 802. In one example, a discharge seal 907 (e.g., a foil, polymer or the like) is positioned over the discharge orifices 905. The generation of the fire suppression aerosol increases the pressure within the container body 802 and ruptures the discharge seal 907 (or melts it) thereby allowing for the discharge of the fire suppression aerosol through the discharge orifices 905 in a manner as previously described herein.

As shown in FIG. 9, the agent cup 902 of the agent assembly 903 and the cooling housing body 900 of the cooling assembly 901 are assembled in series within the container body 802. For instance, as shown in FIG. 9, the agent cup 902 is seated within the cooling housing body 900 and enclosed within the container body 802 by the enclosure cap 808. As will be described in further detail below, the seating of the agent cup 902 within the cooling housing body 900 anchors the agent cup 902 relative to the cooling housing body 900. In another example, where the cooling housing body 900 or agent cup 902 includes spacing members such as the spacing members 914 described in further detail below the spacing members cooperate with interposing layers, such as an insulation layer 924, to support the agent cup (including the fire suppression agent generator 906 therein) as well as the cooling housing body 900 within the fire suppression device 800.

In another example, the engagement of a portion of the enclosure cap, for instance with the agent cup 902 at the second end 803 and the engagement of the container body 802 with the cooling housing body 900 adjacent to the first end 801 axially fixes the agent cup 902, the fire suppression agent generator 906 therein, and the cooling housing body 900 having the screens 908 as well as the cooling media therein. In another example, the snug fitting between the insulation layer 924 and the agent cup 902 as well as the cooling housing body 900 axially and radially positions (e.g., centers) and anchors these components within the container body 802 and thereby substantially prevents radial and axial movement of the components within the container body. The agent cup 902 and the cooling housing body 900 are thereby centered and robustly supported within the container body 802. With the sandwiching of the insulation layer 924 therebetween a deformable substrate is provided between the container body inner wall 904 and the agent cup 902 as well as the cooling housing body 900 to thereby substantially minimize the transmission of dynamic forces such as shock from an impact, vibration and the like to the components of the fire suppression device 800 including the fire suppression agent generator 906.

As shown in FIG. 9, the cooling housing body 900 forms a portion of the cooling assembly 901. The cooling housing body 900 has a perimeter smaller than the inner perimeter of the container body inner wall 904. The cooling housing body 900 is thereby able to easily slide into an installed position as shown in FIG. 9. As previously described, the cooling housing body 900 includes screen supports 910, such as first and second screen supports, at either end of the cooling housing body. In one example, the screen supports 910 (e.g., one or more screen supports) include but are not limited to one or more deflectable tabs formed along the edges of the cooling housing body 900. Deflection of the tabs projects the screen supports 910 toward the interior of the cooling housing body and allows for the positioning of the screens 908 thereon as shown in FIG. 9.

In another example shown in FIG. 9, the cooling assembly 901 includes cup supports 912 (e.g., one or more cup supports) positioned away from the screen supports 910. Stated another way, the screen supports 910 are recessed from the cup supports 912 to form a combustion chamber 918 or gap between the cup support 912 and the screen support 910. In one example, the cup supports 912 are deformable tabs extending along the peripheral edge of the cooling housing body 900. Optionally, the deflectable tabs of the cup supports 912 are shorter than the deflectable tabs of the screen support 910 to thereby ensure the cup supports 912 are spaced from the screen supports 910 to provide the combustion chamber 918. As shown in FIG. 9, the cup supports 912 cooperate with the perimeter of the cooling housing body 900 to form an agent cup seat 916 sized and shaped to receive a corresponding portion of the agent cup 902, such as an agent cup fitting 920. As shown for instance in FIG. 9, the agent cup seat 916 is sized and shaped to closely conform to the perimeter of the agent cup 902 and thereby securely hold the agent cup 902 in the position shown in FIG. 9 upon installation within the container body 802.

As further shown in FIG. 9, the cooling housing body 900, in another example, includes a plurality of spacing members 914 positioned around at least a portion of the perimeter of the cooling housing body 900. In one example, the spacing members 914 include deflectable tabs in a manner similar to the screen supports 910 and cup supports 912. In another example and as shown in FIG. 9, the spacing members 914 include dimples, projections, bosses and the like extending away from the remainder of the cooling housing body 900. The spacing members 914 are sized and shaped to extend toward the container body inner wall 904 from the cooling housing body 900 after installation of the cooling housing body 900 within the container body 802. As shown in FIG. 9 and further described below, the spacing members 914 cooperate with the insulation layer 924 to robustly and securely position the cooling housing body 900 (as well as the agent cup 902 coupled with the cooling housing body) relative to the container body 802. In the example shown in FIG. 9, the spacing members 914 include but are not limited to lanced dimples formed with a mechanical process requiring the deformation of at least a portion of the cooling housing body 900, for instance a metal body such as carbon steel, stainless steel and the like. In another example, the cooling housing body 900 includes a composite polymer, ceramic or the like and the spacing members 914 are correspondingly molded, machined, mechanically formed or the like with the cooling housing body 900.

As previously described, the agent cup 902 is seated with the cooling housing body 900. For instance, as shown in FIG. 9 the agent cup 902 includes an agent cup fitting 920 sized and shaped for reception within the agent cup seat 916. The seating of the agent cup fitting 920 within the agent cup seat 916 correspondingly positions the agent cup 902 with the cooling housing body 900 upon installation of both components within the container body 802. For instance, where the spacing members 914 of the cooling housing body 900 are used for centering and support of the cooling housing body 900 any positioning provided to the cooling housing is similarly provided to the agent cup 902 coupled to the cooling housing body 900 through the interface of the agent cup fitting 920 with the agent cup seat 916. In another example, the agent cup 902 includes a cup flange 922 extending away from a perimeter of the agent cup 902. As will be described in further detail below the cup flange 922 (another example of a spacing member) operates in conjunction with the insulation layer 924 in a similar manner to the spacing members 914. That is to say, the cup flange 922 engages with the insulation layer 924 to robustly support and fix the position of the agent cup 912 (as well as the cooling housing body 900) radially (and axially in some examples) within the container body 802.

During assembly of the fire suppression device 800, in one example the cooling housing body 900 of the cooling assembly 901 is assembled or coupled with the agent cup 902 of the agent assembly 903. For instance, the agent cup fitting 920 of the agent cup 902 is seated within the agent cup seat 916 of the cooling housing body 900 and the agent cup opening 909 is correspondingly directed toward the cooling media. As previously described, the seating of the agent cup 902 within the cooling housing body 900 positions the agent cup 902 in series with the cooling housing body 900. In one example, the coupling as shown in FIG. 9, further forms the combustion chamber 918 between the agent cup 902 as well as the portion of the cooling housing body 900 containing the cooling media therein (e.g., between the screens 908 shown in FIG. 9).

Prior to installation within the container body 802, in one example, the insulation layer 924, for instance, a blanket or wrap of insulation is coupled around the perimeter of the assembled agent cup 902 and the cooling housing body 900. The subassembly of the agent cup 902, cooling housing body 900 and the insulation layer 924 is installed into the container body 802, for instance along the container body inner wall 904. As shown in FIG. 9, the insulation layer 924 is interposed between the container body inner wall 904 and the perimeters of both the agent cup 902 and the cooling housing body 900.

As shown in FIG. 9, the provision of the spacing members 914 provides a tight clamping engagement between at least the cooling housing body 900 and the container body 802. For instance, a portion of the insulation layer 924 is deformably compressed as shown in FIG. 9. The clamped portions 926 are, in one example, positioned around the perimeter of the cooling housing body 900 as shown in FIG. 9. The deformation of the insulation layer 924 provides a corresponding counter bias from the insulation layer 924 that fixes and robustly supports the cooling housing body 900 within the container body 802. The coupling of the agent cup 902 with the cooling housing body 900, for instance at the interface between the agent cup seat 916 and the agent cup fitting 920, correspondingly positions the agent cup 902 according to the positioning of the cooling housing body 900 through the spacing members 914 and the insulation layer 924. Stated another way, the clamping engagement of the insulation layer 924 between the spacing members 914 and the container body inner wall 904 substantially centers and radially positions the cooling housing body 900 away from the container body inner wall 904 and thereby substantially isolates both the agent cup 902 and the cooling housing body 900 from dynamic forces transmitted through the container body 802, for instance, through direct contact between the container body 802 with one or more of the cooling housing body 900 or the agent cup 902. Additionally, the snug engagement between the spacing members 914 and the container body inner wall 904 along the insulation layer 924 axially and radially fixes the cooling housing body 900 and the agent cup 902.

Optionally and as previously described above, the agent cup 902 includes a spacing member, such as the cup flange 922. As shown in FIG. 9, the cup flange 922 engages with the insulation layer 924 in a similar manner to the spacing members 914 of the cooling housing body 902. That is to say, the cup flange 922 provides a second clamped portion 928 extending around at least a portion of the perimeter of the agent cup 902. The cup flange 922 compresses the insulation layer 924 to provide a clamping engagement between the cup flange 922 and the container body inner wall 904. In one example, the second clamped portion 928 generated by the cup flange 922 deformably engaging the insulation layer 924 assists with or further enhances the radially and axially fixing and supporting of the components of the agent assembly 903 and the cooling housing body 900. That is to say, the fire suppression agent generator 906 and the cooling media within the cooling housing body 900 are supported in a position away from the container body inner wall 904 by the cup flange 922 and the spacing members 914.

Additionally, the insulation layer 924 provides thermal insulation to the fire suppression agent generator 906. For instance, cyclical heating within an engine compartment is mitigated within the fire suppression device 800 by the provision of the insulation layer 924. The fire suppression agent generator 906 is thereby correspondingly not exposed to extreme cyclical heat loads, for instance by the operation of an engine and discontinuing of operation of the engine over the lifetime of operation of the fire suppression device 800. The fire suppression agent generator 906 is thereby not exposed to rapid extreme cyclical temperatures that could otherwise harm or affect the performance of the fire suppression agent generator 906.

As previously described, one or more of the spacing members 914 and the cup flange 922 engages the insulation layer 924 at clamped portions 926, 928 to deform at least a portion of the insulation layer. As shown in FIG. 9, the remainder of the insulation layer 924 remains substantially uncompressed, for instance by the engagement of the perimeters of the cooling housing body 900 and the agent cup 902 and the opposing engagement of the container body inner wall 904 of the container body 802. Stated another way, the spacing members 914 and the cup flange 922 cooperate to ensure the insulation layer 924 is only deformed at the corresponding localized clamped portions 926, 928. The remainder of the insulation layer 924 remains substantially uncompressed (aside from incidental compression caused between the opposing surfaces) and the insulation layer 924 is thereby able to operate at an enhanced efficiency according to the original configuration of the insulation layer 924 (for instance, a woven or non-woven fibrous type material designed to include at least some spacing between the fibers to thereby enhance the thermal insulative properties of the insulation layer). That is to say the remainder of the insulation layer 924 is isolated from the compression present at the clamp portions 926, 928 and is thereby able to provide enhanced insulation (e.g., thermal based insulation) to the components of the fire suppression device 800 including the fire suppression agent generator 906.

Figure 10B:
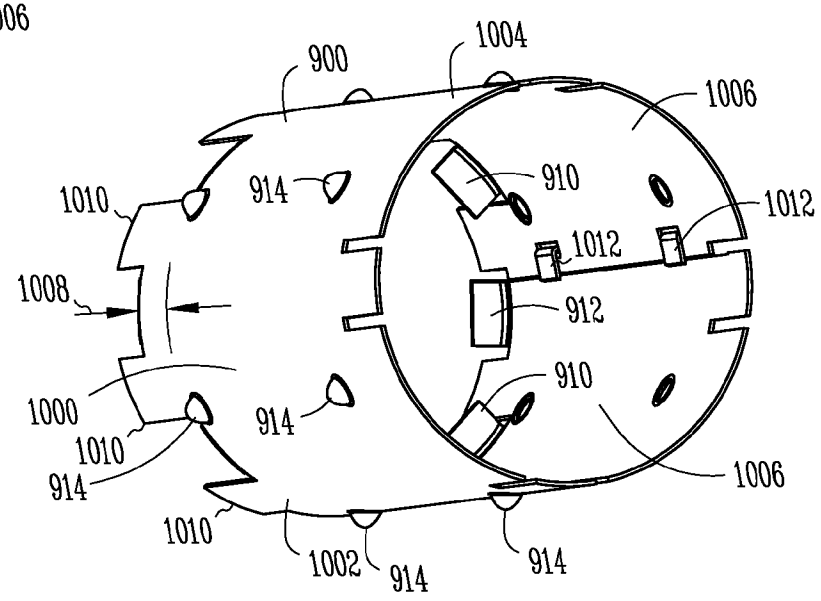
FIG. 10B is a bottom perspective view of the cooling housing of FIG. 10A.
Figure 10A:
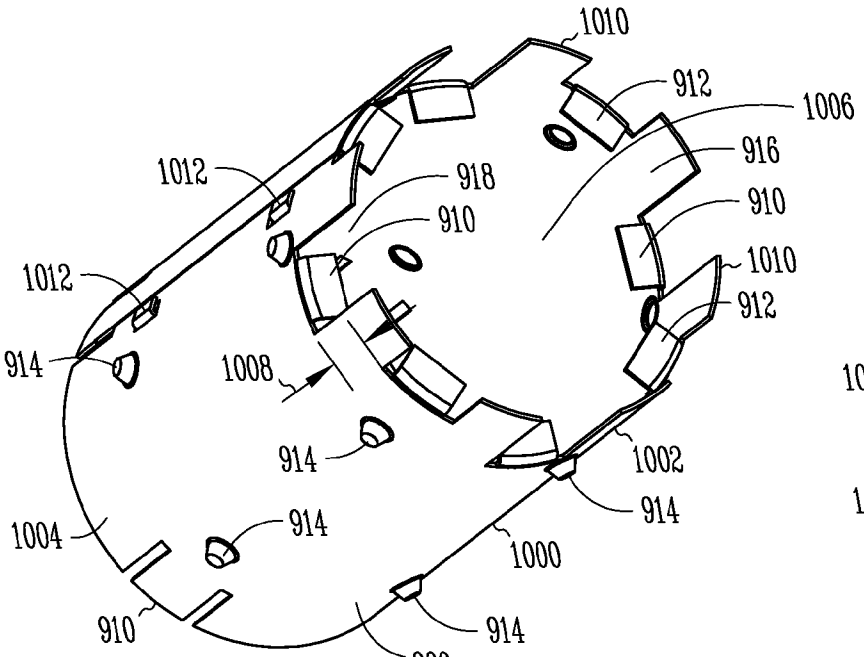
FIG. 10A is a top perspective view of one example of a cooling housing.

FIGS. 10A and 10B show perspective views of the cooling housing body 900 previously shown in FIG. 9. In FIG. 10A the cooling housing body 900 is shown with the top portion or a first end 1002 oriented outward relative to the page. As previously described, the cooling housing body 900 includes a plurality of supports such as cup supports 912 and screen supports 910. As shown in FIG. 10A, both the cup supports 912 and the screen supports 910 are positioned adjacent to the first end 1002. As further shown in FIG. 10A, the screen supports 910 are in one example recessed relative to the cup supports 912. As previously described and shown in FIG. 9, the recessing of the screen supports 910 relative to the cup supports 912 forms the combustion chamber 918 according to the support gap 1008 shown in FIG. 10A. For instance, as shown the screen supports 910 are recessed relative to the cup supports 912, for instance, by cutting of the screen supports 910 in a recessed fashion relative to the cup supports 912.

Referring again to FIG. 10A, the plurality of screen supports 910 and cup supports 912 are, in one example, one or more deflectable tabs. For instance, the material of the cooling housing body, such as a metal including, for instance carbon steel, stainless steel, and the like, is deflected at each of the supports 910, 912 to correspondingly bend the supports into the interior of the cooling housing body 900 to form the corresponding supports. In one example, the screen supports 910 are formed prior to the cup supports 912. The forming of the screen supports 910 allows for the coupling of the screen 908 thereon, for instance, by bending of the screen supports 910 over the top of the installed screen 908 shown in FIG. 9. The bending of the screen supports 910 deflects the supports over top of the screen 908 and thereby holds the screen 908 and any cooling media therein within the cooling media chamber 1006 shown in FIG. 10A.

In another example, at the first end 1002 a plurality of seat prongs 1010 are staggered around the housing perimeter 1000. For instance, as shown in FIG. 10A the seat prongs 1010 form a broken perimeter for the agent cup seat 916. As described previously, the cup supports 912 as well as the remainder of the cooling housing body 900 such as the seat prongs 1010 cooperate to the form the agent cup seat 916 shown in FIG. 10A. The cup supports 912 form the base of the agent cup seat 916 and the seat prongs 1010 form the perimeter of the agent cup seat 916. The agent cup seat 916 is sized and shaped to provide a snug fitting engagement with the agent cup 902 including the agent cup fitting 920 shown in FIG. 9.

Referring to both FIGS. 10A and 10B, the spacing members 914 (previously shown in FIG. 9) are shown in perspective. The spacing members 914 extend away from the cooling housing body 900 to provide the spacing engagement with the insulation layer 924 shown in FIG. 9. The spacing members 914 compress a portion of the insulation layer 924. For instance, clamped portions 926 of the insulation layer 924 compressed by the spacing members 914 provide a snug supporting engagement to the cooling housing body 900 and the agent cup 902 coupled with the housing body 900. Additionally, the spacing members 914 space the housing perimeter 1000 from the container body inner wall 904 to thereby ensure the insulation layer 924 is not crushed by a large portion of the cooling housing body 900. That is to say, the spacing members 914 space the cooling housing body 900 from the container body inner wall 904 and thereby preserve a majority of the insulation layer 924 in an uncompressed configuration as shown in FIG. 9.

In one example, the spacing members 914 include but are not limited to lanced dimples formed in the housing perimeter 1000. For instance, the spacing members 914 are formed by punching of the housing perimeter 1000 or other mechanical mechanisms. In a similar fashion, the spacing members 914 may also be formed in the agent cup 902 in addition to or as an alternative to the spacing members 914 show in the cooling body 900. For instance, lanced dimples are formed in the agent cup 902 to further provide the spacing function to the agent cup 902 otherwise provided for by the cooling housing body 900.

Referring to FIG. 10B, the cooling media chamber 1006 is shown formed between the screen supports 910 including the deflected supports shown in FIG. 10B at the first end 1002 and the undeflected supports shown at the second end 1004. In one example, the cooling media chamber 1006 is sized and shaped to receive a cooling media therein such as crushed marble, alumina, or the like (see the other examples of cooling media described herein). At the time of assembly of the fire suppression device 800, in one example, the screen supports 910 at the second end 1004 are deflected inwardly relative to the cooling housing body 900 such as the housing perimeter 1000. A first screen 908 is positioned on top of the screen supports 910 as shown in FIG. 9. The cooling housing body 900, for instance the cooling media chamber 1006, is thereafter filled with a cooling media and a second screen 908 is positioned over top of the cooling media within the cooling media chamber 1006. The screen supports 910 at the first end 1002 are deflected as shown in FIG. 10A to thereby move the screen supports 910 over top of the screen 908 and constrain the cooling media to the cooling media chamber 1006.

Figure 10C:
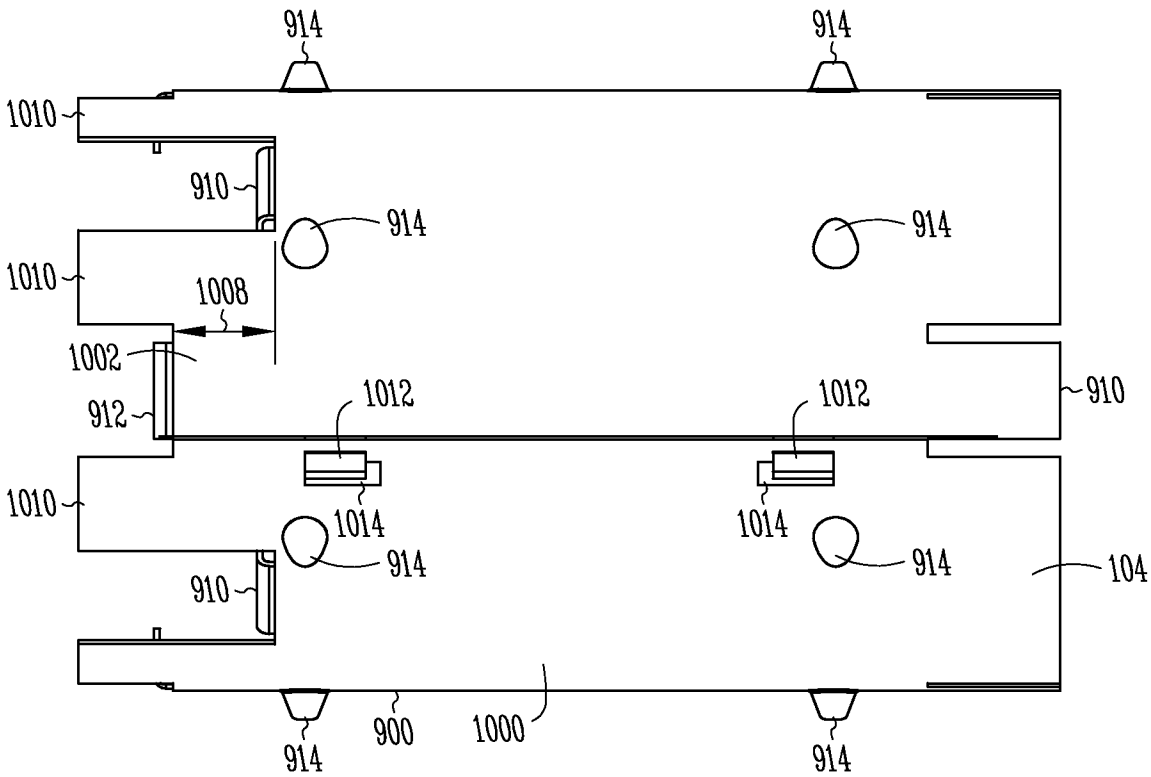
FIG. 10C is a side view of the cooling housing of FIG. 10A.

The cup supports 912 are thereafter deflected into the configuration shown in FIG. 10A to provide the agent cup seat 916 shown in FIGS. 9 and 10A. As shown, the cup supports 912 are spaced from the screen supports 910 according to the support gap 1008 shown in FIGS. 10A and 10B. The support gap 1008 is also shown in FIG. 10C. As shown in FIGS. 10A-10C, the support gap 1008 provides the combustion chamber 918 between the cup supports 912 and the screen supports 910. As shown for instance in FIG. 9, the combustion chamber 918 provided by the support gap 1008 spaces the fire suppression agent generator 906 from the cooling media within the cooling media chamber 1006 to provide a chamber for complete combustion of the fire suppression agent prior generator material prior to delivery of a fire suppression aerosol through the cooling media within the cooling housing body 900 and subsequent discharge through the discharge orifices 905 shown in FIG. 9.

Referring again to FIG. 10C, a plurality of fasteners 1012 are shown for the cooling housing body 900. In one example, the cooling housing body 900 is formed from a substantially flat piece of metal that is thereafter formed into a cylinder such as the cylinder shown in FIGS. 10A and 10B. To ensure a consistent diameter and shape to the cooling housing body 900, one or more fasteners 1012, such as deflectable tabs, are formed at an end of a portion of the blank used in the cooling housing body 900. Upon formation such as by wrapping of the cooling housing body blank over a mandrel the one or more fasteners 1012 are fitted through corresponding fastener openings 1014 to thereby ensure the formed cooling housing body 900 has a consistent diameter and shape. Optionally, the fasteners 1012 are deformed, for instance as deflectable tabs, into the configuration shown in FIG. 10C. In another example, the fasteners 1012 are welded with the opposed portion of the cooling housing body 900. In yet another example, the fasteners 1012 are deformed into the orientation shown in FIG. 10C and thereafter welded in place to fix each of the ends of the cooling housing body blank to thereby form the cylinder shown in FIG. 10A.

Figure 11B:
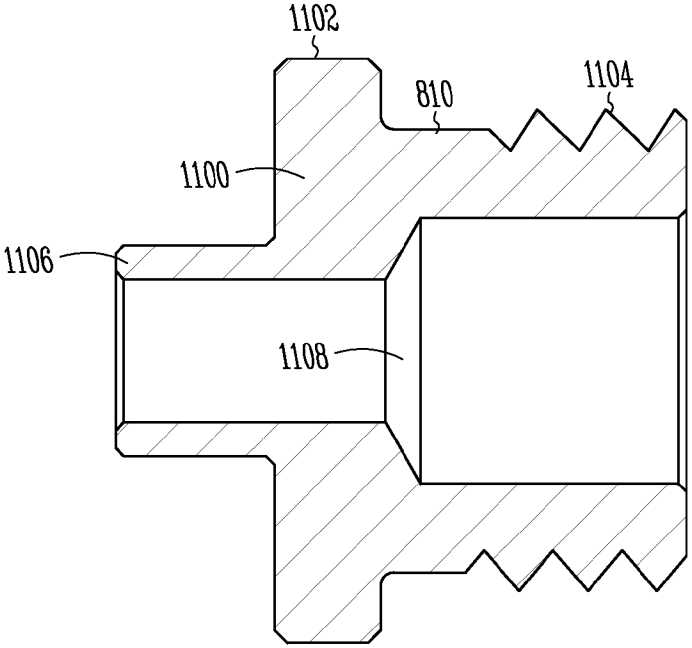
FIG. 11B is a cross sectional view of the ignition assembly fitting of FIG. 11.
Figure 11A:
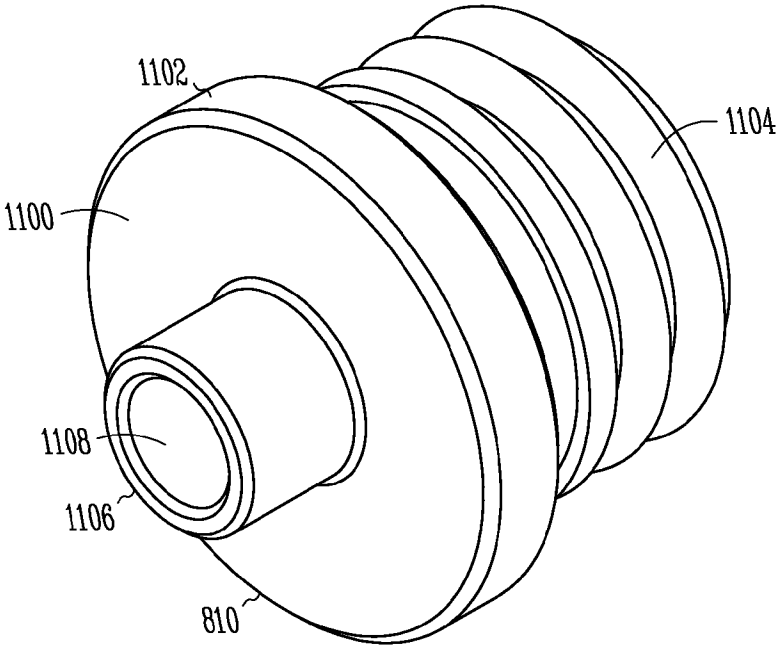
FIG. 11A is a perspective view of one example of an ignition assembly fitting.

One example of an ignition assembly fitting 810 for use with the ignition assembly 804 is shown in FIGS. 11A and 11B. Referring first to FIG. 11A, the ignition assembly fitting 810 is shown in a perspective view. The ignition assembly 810 includes, in one example, a fitting body 1100 including, for instance, a fitting flange 1102 sized and shaped to engage with a corresponding portion of the enclosure cap 808 as shown in FIG. 8. In another example, the ignition assembly fitting 810 includes a fitting lumen 1108 sized and shaped to pass a portion of the ignition assembly 804, such as a wire, therethrough into the fire suppression device 800, for instance to a position adjacent to the fire suppression agent generator 906 shown in FIG. 9. For instance, the wiring of the ignition assembly connector 806 is coupled with a flammable substance, electrical heating feature or the like. Optionally, the wiring extending through the fitting lumen 1108 is an ignitable cord, flammable substance, or the like.

Referring again to FIGS. 11A and 11B, the ignition assembly fitting 810 includes a coupling feature 1104 sized and shaped for reception within the enclosure cap 808. In one example, the coupling feature 1104 includes but is not limited to a mechanical interference fitting, threading, and the like sized and shaped to engage with corresponding features within the enclosure cap 808 to substantially fix at least a portion of the ignition assembly 804 relative to the fire suppression device 800.

In another example, the ignition assembly fitting 810 includes a deflectable barrel 1106. The deflectable barrel 1106 is constructed with a material that is capable of deforming and retaining its shape after being deformed. For instance, in example the deflectable barrel 1106 is constructed with steel, brass and the like. The deflectable barrel 1106 is sized and shaped upon deformation to engage with a wire such as the wire shown in FIG. 8 and thereby hold that portion of the ignition assembly 804 relative to the ignition assembly fitting 810. For instance, after installation of the wire and ignitable cord and the like through the deformable barrel 1106, the deformable barrel 1106 is closed, for instance, with a crimping tool to clamp at least a portion of the deformable barrel around the wire or ignitable cord. Optionally, a sealant or adhesive is applied within the barrel 1106 (alone or in combination with deformation) to hold the wire or ignitable cord therein. Additionally, the sealant or adhesive closes and seals the fire suppression device 800.

The ignition assembly fitting 810 when coupled with the ignitable cord or wire forms the ignition assembly 804. This assembly is then installed as a unit in the fire suppression device 800, for instance by screwing or pushing of the ignition assembly fitting 810 into snug fitting engagement with the enclosure cap 808 as shown in FIG. 8. If desired, an additional sealing element, such as an epoxy, is included at or adjacent to the interface of the fitting and 810 with the enclosure cap 808. The sealing element optionally seals the fire suppression device 800 in a similar manner to a sealant in the deformable barrel 1106 to substantially prevent the ingress of debris, moisture and the like into the device 800.

The installation of the ignition assembly fitting 810, in one example, positions the ignition component such as the arc generator, flammable material, and the like in close proximity to the fire suppression agent generator 906. For instance, as shown in FIG. 9 the coupling of the ignition assembly fitting 810 with the remainder of the ignition assembly 804 positions the ignition component (one example of the ignition component is shown in FIG. 5B) adjacent to the fire suppression agent generator 906, for instance in a lumen extending through a portion of the fire suppression agent generator. The fixed position of the ignition assembly fitting 810 correspondingly ensures that the ignition component positioned within the fire suppression agent generator 906 is fixed in place and ensures reliable operation of the fire suppression device 800 including ignition of the fire suppression agent generator.

Figure 12:
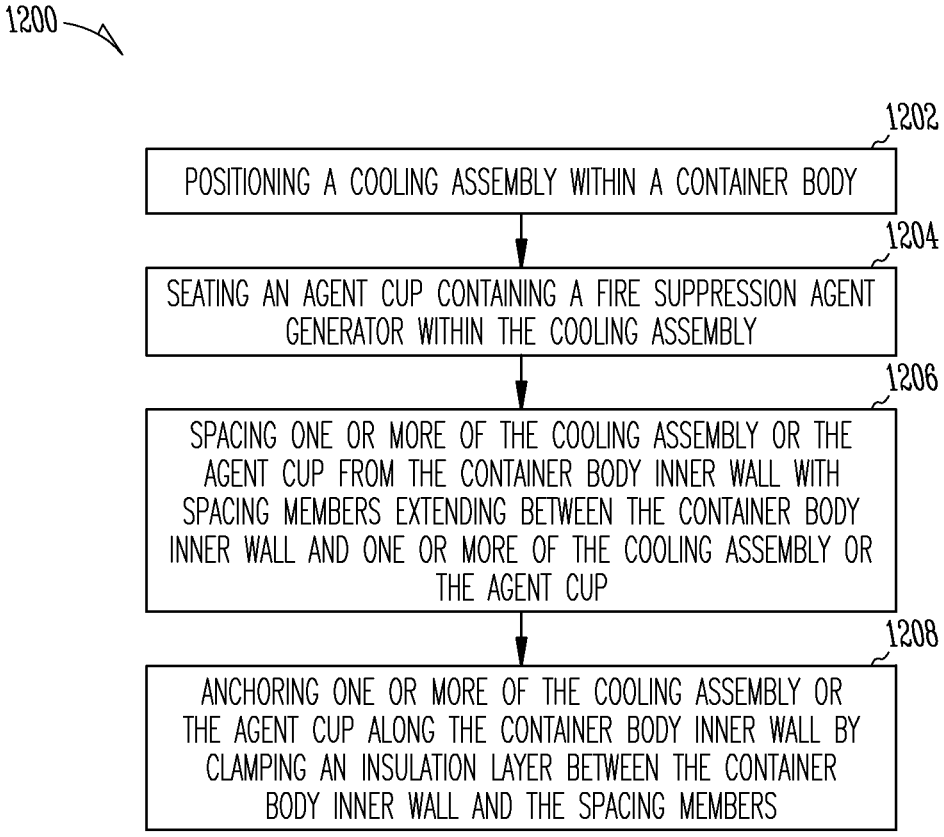
FIG. 12 is a block diagram showing one example of a method for making a fire suppression device.

FIG. 12 shows a block diagram illustrating one example of a method 1200 for making a fire suppression device such as the fire suppression devices 100, 200, 800 described herein. In describing the method 1200 reference is made to features and elements previously described herein including numbered references where convenient. Numbered elements provided within the description of the method 1200 are not intended to be limiting. Instead, numbered references are provided for convenience and further include any similar features described herein as well as their equivalents. For instance, in describing the method 1200 reference will be made to at least the fire suppression device 800. The method 1200 is not however limited to the fire suppression device 800. Instead the method 1200 includes, but is not limited to, the fire suppression devices 100, 200 previously described herein as well as their associated components.

At 1202, the method 1200 includes positioning a cooling assembly 901 within a container body, such as the container body 802 previously shown in FIGS. 8 and 9. For instance, in one example, the cooling assembly 901 includes the cooling housing body 900 slidably positioned within the container body 802 as shown in FIG. 9.

At 1204, an agent cup 902 of the agent assembly 903 is seated within the cooling assembly 901. The agent assembly 901 includes, for instance, a fire suppression agent generator 906 positioned within the agent cup 902. As further described herein, the agent cup 902 includes (in a similar manner to the other examples described herein) a passage 909 therethrough allowing for the discharge of fire suppression agent such as a fire suppression agent aerosol from the agent cup 902 and into the cooling housing body 900. As further described herein, in one example, seating the agent cup 902 containing the fire suppression agent generator 906 within the cooling assembly 901 includes fitting an agent cup fitting 920 of the agent cup within an agent cup seat 916 of the cooling housing body 900. As shown for instance in FIG. 9, the agent cup fitting 920 is has a complementary perimeter to the agent cup seat 916 and is thereby closely fitted to the cooling housing body 900 to ensure the agent cup 902 is substantially prevented from moving at least laterally relative to the cooling housing body 900.

At 1206, the method 1200 includes spacing one or more of the cooling assembly 901 or the agent cup 902 (e.g., the agent assembly 903) from the container body inner wall such as the container body inner wall 904 shown in FIG. 9. As described herein one or more spacing members 914 extend between the container body inner wall 904 and one or more of the cooling assembly 901 or the agent cup 902 (forming part of the agent assembly 903). For instance as described herein in one example, the one or more spacing members 914 are lanced dimples formed in the housing perimeter 1000 of the cooling housing body 900.

At 1208, one or more of the cooling assembly 901 or the agent cup 902 of the agent assembly 903 are anchored along the container body inner wall 904 by clamping an insulation layer 924 between the container body inner wall 904 and the spacing members 914. In one example, spacing one or more of the cooling assembly 901 or the agent cup 902 includes spacing the cooling assembly 901 (for instance, the cooling housing body 900) from the container body inner wall 904 with the spacing members 914 extending from the cooling assembly 901. For example, the plurality of spacing members 914 are lanced dimples formed in the cooling housing body 900 and extend away from the cooling housing body 900 toward the container body inner wall 904 when installed as shown in FIG. 9. In yet another example, spacing one or more of the cooling assembly or the agent cup includes spacing the agent cup 902 from the container body inner wall 904. The agent cup 902 is, in one example, spaced according to the spacing members 914 (or the cup flange 922) extending from the cooling assembly as well as by lateral positioning through seating of the agent cup fitting 920 of the agent cup 902 within an agent cup seat 916 of the cooling assembly 901. Stated another way, where the spacing members 914 are positioned along the perimeter of the cooling housing body 900 the cooling housing body 900 is correspondingly centered as shown in FIG. 9, for instance, by the engagement of the plurality of spacing members 914 with the surrounding insulation layer 924. The agent cup 902 seated within the cooling housing body 900 is correspondingly positioned according to the centering and support provided by the spacing members 914 in clamping engagement between the container body inner wall 904 with the insulation layer 924 interposed therebetween.

As described herein, in one example the agent cup 902 includes its own cup flange 922 sized and shaped to similarly engage with the insulation layer 924 and thereby supplement the positioning provided by the cooling housing body 900 by providing another centering and engagement feature in clamping engagement with the insulation layer 924 (with the container body inner wall 904 on the opposed side of the insulation layer 924). Optionally, one or more of the spacing members 914 (including the cup flange 922) are formed along the container body inner wall 904 and extend toward one or more of the agent cup 902 and the cooling housing body 900.

Several options for the method 1200 follow. In one example, anchoring one or more of the cooling assembly 901 or the agent assembly 903 (such as the agent cup 902) includes clamping a portion of the insulation layer 924 between the spacing members 914 and the container body inner wall 904. Anchoring one or more of the cooling assembly or the agent cup includes in yet another example, isolating the remainder of the insulation layer 924 from compression, for instance by the clamping of the insulation layer between the spacing members and the container body inner wall 904. The spacing members 914 instead recess one or more of the agent cup 902 or the cooling housing body 900 of the cooling assembly 901 from compressing engagement with the insulation layer 924. For instance, as shown in FIG. 9, the remainder of the insulation layer 924 away from the clamped portions 926 and 928 is substantially uncompressed between the container body inner wall 904 and one or more of the agent cup 902 and the cooling housing body 900. Stated another way, only those portions of the insulation layer 924 clamped between the spacing members 914 and the container body inner wall 904 are compressed as shown in FIG. 9. The remainder of the insulation layer 924, for instance in those areas not at the clamping portions 926, 928, is left substantially uncompressed thereby allowing for the robust insulation of the components of the fire suppression device 800.

In yet another example, the method 1200 includes assembling the cooling assembly 901. In one option, assembling the cooling assembly 901 includes forming a cooling housing body 900 including a cooling media chamber, such as the cooling media chamber 1006 shown in FIGS. 10A and 10B. A first screen support 910 is formed near an end 1004 shown in FIG. 10A. A second screen support 910 is formed near another end 1002 of the cooling media chamber 1006.

An agent cup seat 916 is shown in FIG. 9. The agent cup seat 916 is formed near the end 1002 of the cooling media chamber 1006. For instance, in one example forming the first screen support 910 and forming the agent cup seat 916 includes deflecting a first deformable tab near the end 1002 of the cooling media chamber 1006. A second formable tab is deflected near the end 1002 of the cooling media 1006 to form the agent cup seat 916. The first deformable tab, for instance of the screen support 910, is recessed relative to the second deformable tab of the cup support 912. As shown for instance in FIGS. 10A-C, the screen support 910 at the first end 1002 is recessed relative to the cup support 912 according to a support gap 1008. In one example, the support gap 1008 corresponds to the distance provided as the combustion chamber 918 shown in FIG. 9. The combustion chamber 908 provides passage between the fire suppression agent generator 906 and the cooling media within the cooling housing body 900 to facilitate the burning of the generator 906 and generation of a fire suppression aerosol. Optionally as described herein, forming the combustion chamber 908, in one example, includes spacing of the first screen support, such as the screen support 910 shown adjacent to the first end 1002 of the cooling housing body 900, from an agent cup seat 916 of the cooling housing body 900 (see FIG. 10A).

In yet another example, the method 1200 includes coupling an ignition assembly 806 (see FIG. 8) with the fire suppression agent generator 906 within the agent cup 902. Optionally, the method 1200 includes clamping at least one ignition wire (e.g., an electrical wire, an ignition cord and the like) with a deformable portion of a fitting such as the ignition assembly fitting 810. As shown, for instance, in FIGS. 11A and 11B the ignition assembly fitting 810 includes a deformable barrel 1106. The deformable barrel 1106 is deformed (e.g., by crimping) to fix the fitting 810 with the ignition wire and form a unitary ignition assembly, such as the assembly 804 shown in FIG. 8. The ignition assembly 804 is thereafter coupled with the fire suppression agent generator 906, for instance, by coupling of the fitting 810 with an enclosure cap 808 coupled with the container body 802 (see FIG. 8).

Various Notes & Examples

Example 1 can include subject matter, such as an apparatus, that may include A fire suppression device comprising a container body including at least one discharge orifice; a cooling assembly coupled along a container body inner wall, the cooling assembly includes a cooling housing body with a cooling media therein, and an agent cup seat; an agent assembly coupled along the container body inner wall, the agent assembly includes an agent cup with a fire suppression agent generator therein, and an agent cup fitting near an end of the agent cup, the agent cup fitting is coupled with the agent cup seat; a plurality of spacing members extending between the container body inner wall and at least one of the cooling housing body and the agent cup, both of the cooling housing body and the agent cup are spaced from the container body inner wall by the plurality of spacing members; and an insulation layer coupled between the container body inner wall and the plurality of spacing members, and a portion of the insulation layer is clamped between one or more of the spacing members and the container body inner wall.

Example 2 can include, or can optionally be combined with the subject matter of Example 1, to optionally include wherein the plurality of spacing members and the insulation layer clamped between the one or more of the spacing members and the container body anchors the cooling housing body and the agent cup within the container body.

Example 3 can include, or can optionally be combined with the subject matter of one or any combination of Examples 1 or 2 to optionally include wherein the clamped insulation layer and the one or more spacing members center the cooling housing body and the agent cup within the container body.

Example 4 can include, or can optionally be combined with the subject matter of one or any combination of Examples 1-3 to optionally include wherein the portion of the insulation layer is compressed between the one or more spacing members and the container wall and one or more of the cooling housing body or the agent cup are recessed from compressing engagement with a majority portion of the insulation layer by the one or more spacing members.

Example 5 can include, or can optionally be combined with the subject matter of one or any combination of Examples 1-3 to optionally include wherein the agent cup includes a cup installation flange, and another portion of the insulation layer is clamped between the cup installation flange and the container body inner wall.

Example 6 can include, or can optionally be combined with the subject matter of Examples 1-5 to optionally include wherein the agent cup is spaced from the cooling media by a combustion chamber gap formed therebetween by the agent cup fitting and a screen of the cooling assembly extending over the cooling media.

Example 7 can include, or can optionally be combined with the subject matter of Examples 1-6 to optionally include a pressure pad interposed between the fire suppression agent generator and an enclosure cap coupled with the container body, the pressure pad axially anchors the agent assembly and the cooling assembly within the container body, and one or more of the pressure pad, the plurality of spacing members or the clamped insulation layer anchors the agent assembly and the cooling assembly within the container body.

Example 8 can include, or can optionally be combined with the subject matter of Examples 1-7 to optionally include an ignition assembly positioned within the fire suppression agent generator.

Example 9 can include, or can optionally be combined with the subject matter of Examples 1-8 to optionally include an enclosure cap coupled along the container body; wherein the ignition assembly is fixed within a fitting, and the fitting is coupled with the enclosure cap.

Example 10 can include, or can optionally be combined with the subject matter of Examples 1-9 to optionally include wherein the ignition assembly includes a deformable thermal trigger, and at least a portion of the deformable thermal trigger deforms at a specified temperature to ignite the fire suppression agent generator.

Example 11 can include, or can optionally be combined with the subject matter of one or any combination of Examples 1-10 to include, subject matter, such as an apparatus, that may include a cooling assembly, the cooling assembly comprising a cooling housing body including a cooling media chamber, the cooling housing body includes a first screen support near a first end of the cooling media chamber, a second screen support near a second end of the cooling media chamber, an agent cup seat near one of the first or the second end, and a plurality of spacing members extending from the cooling housing body; a cooling media within the cooling housing body; and screens coupled with the cooling housing body at the first and second screen supports respectively.

Example 12 can include, or can optionally be combined with the subject matter of Examples 1-11 to optionally include wherein the cooling housing body includes a plurality of deflectable tabs at the first or the second end, at least a first deflectable tab is deflected into the first or second screen support, and at least a second deflectable tab is deflected into the agent cup seat.

Example 13 can include, or can optionally be combined with the subject matter of Examples 1-12 to optionally include wherein the first deflectable tab corresponding to the first or second screen support is recessed relative to the second deflectable tab corresponding to the agent cup seat in a longitudinal direction from the first or the second end.

Example 14 can include, or can optionally be combined with the subject matter of Examples 1-13 to optionally include wherein the plurality of deflectable tabs are staggered around the container body.

Example 15 can include, or can optionally be combined with the subject matter of Examples 1-14 to optionally include wherein the plurality of spacing members include lanced dimples formed in the container body.

Example 16 can include, or can optionally be combined with the subject matter of Examples 1-15 to optionally include an agent cup having a fire suppression agent generator therein, the agent cup includes an agent cup fitting received within the agent cup seat; and a container body having a container body inner wall, and the agent cup and the cooling assembly are coupled within the container body along the container body inner wall.

Example 17 can include, or can optionally be combined with the subject matter of Examples 1-16 to optionally include an insulation layer extending around the agent cup and the cooling housing body, a portion of the insulation layer is compressed between the plurality of spacing members and the container body inner wall, and the compressed insulation layer anchors and supports one or more of the cooling housing body or the agent cup.

Example 18 can include, or can optionally be combined with the subject matter of one or any combination of Examples 1-17 to include, subject matter, such as a method, that can include positioning a cooling assembly within a container body; seating an agent cup containing a fire suppression agent generator within the cooling assembly; spacing one or more of the cooling assembly or the agent cup from the container body inner wall with spacing members extending between the container body inner wall and one or more of the cooling assembly or the agent cup; and anchoring one or more of the cooling assembly or the agent cup along the container body inner wall by clamping an insulation layer between the container body inner wall and the spacing members.

Example 19 can include, or can optionally be combined with the subject matter of Examples 1-18 to optionally include spacing one or more of the cooling assembly or the agent cup includes spacing the cooling assembly from the container body inner wall with the spacing members extending from the cooling assembly, and spacing the agent cup from the container body inner wall, wherein the agent cup is spaced according to the spacing members extending from the cooling assembly and lateral positioning through seating of an agent cup fitting of the agent cup within an agent cup seat of the cooling assembly.

Example 20 can include, or can optionally be combined with the subject matter of Examples 1-19 to optionally include wherein anchoring one or more of the cooling assembly or the agent cup includes clamping a portion of the insulation layer between the spacing members and the container body inner wall, and isolating the remainder of the insulation layer from compression, the spacing members recessing one or more of the agent cup or a cooling housing body of the cooling assembly from compressing engagement with the insulation layer.

Example 21 can include, or can optionally be combined with the subject matter of Examples 1-20 to optionally include The method of claim 18 comprising assembling the cooling assembly, assembling the cooling assembly including forming a cooling housing body including a cooling media chamber, forming a first screen support near a first end of the cooling media chamber, forming a second screen support near a second end of the cooling media chamber, and forming an agent cup seat near the first end of the cooling media chamber.

Example 22 can include, or can optionally be combined with the subject matter of Examples 1-21 to optionally include wherein forming the first screen support and forming the agent cup seat includes deflecting a first deformable tab near the first end of the cooling media chamber to form the first screen support, and deflecting a second deformable tab near the first end of the cooling media chamber to form the agent cup seat, the first deformable tab is recessed relative to the second deformable tab.

Example 23 can include, or can optionally be combined with the subject matter of Examples 1-22 to optionally include forming a combustion chamber between the fire suppression agent generator of the agent cup and a cooling media in the cooling assembly.

Example 24 can include, or can optionally be combined with the subject matter of Examples 1-23 to optionally include wherein forming the combustion chamber includes spacing a first screen support of a cooling housing body of the cooling assembly from an agent cup seat of the cooling housing body.

Example 25 can include, or can optionally be combined with the subject matter of Examples 1-24 to optionally include forming the spacing members in a cooling housing body of the cooling assembly.

Example 26 can include, or can optionally be combined with the subject matter of Examples 1-25 to optionally include wherein forming the spacing members includes forming lanced dimples in a sidewall of the container housing body.

Example 27 can include, or can optionally be combined with the subject matter of Examples 1-26 to optionally include coupling an ignition assembly with the fire suppression agent generator within the agent cup.

Example 28 can include, or can optionally be combined with the subject matter of Examples 1-27 to optionally include clamping at least one ignition wire with a deformable portion of a fitting, and coupling the ignition assembly with the fire suppression agent generator includes coupling the fitting with an enclosure cap coupled with the container body.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A fire suppression device comprising:

a container body including at least one discharge orifice;

a cooling assembly coupled along a container body inner wall, the cooling assembly includes:

a cooling housing body with a cooling media therein, and an agent cup seat;

an agent assembly coupled along the container body inner wall, the agent assembly includes:

an agent cup with a fire suppression agent generator therein, and an agent cup fitting near an end of the agent cup, the agent cup fitting is coupled with the agent cup seat;

a plurality of spacing members extending (1) between the container body inner wall and the cooling housing body, or (2) between the container body inner wall and the agent cup, or (3) between the container body inner wall and both the cooling housing body and the agent cup, wherein both of the cooling housing body and the agent cup are spaced from the container body inner wall by the plurality of spacing members; and an insulation layer coupled between the container body inner wall and at least one of the cooling housing body and the agent cup, wherein a portion of the insulation layer is clamped between one or more of the spacing members and the container body inner wall.

2. The fire suppression device of claim 1, wherein the plurality of spacing members and the insulation layer clamped between the one or more of the spacing members and the container body anchors the cooling housing body and the agent cup within the container body.

3. The fire suppression device of claim 1, wherein the clamped insulation layer and the one or more spacing members center the cooling housing body and the agent cup within the container body.

4. The fire suppression device of claim 1, wherein the portion of the insulation layer is compressed between the one or more spacing members and the container wall and one or more of the cooling housing body or the agent cup are recessed from compressing engagement with a majority portion of the insulation layer by the one or more spacing members.

5. The fire suppression device of claim 1, wherein the agent cup includes a cup installation flange, and another portion of the insulation layer is clamped between the cup installation flange and the container body inner wall.

6. The fire suppression device of claim 1, wherein the agent cup is spaced from the cooling media by a combustion chamber gap formed therebetween by the agent cup fitting and a screen of the cooling assembly extending over the cooling media.

7. The fire suppression device of claim 1 comprising a pressure pad interposed between the fire suppression agent generator and an enclosure cap coupled with the container body, the pressure pad axially anchors the agent assembly and the cooling assembly within the container body, and one or more of the pressure pad, the plurality of spacing members or the clamped insulation layer anchors the agent assembly and the cooling assembly within the container body.

8. The fire suppression device of claim 1, comprising an ignition assembly positioned within the fire suppression agent generator.

9. The fire suppression device of claim 8 wherein the ignition assembly includes a deformable thermal trigger, and at least a portion of the deformable thermal trigger deforms at a specified temperature to ignite the fire suppression agent generator.

* * * * *